US011369238B2

(12) United States Patent
Paré et al.

(10) Patent No.: US 11,369,238 B2
(45) Date of Patent: Jun. 28, 2022

(54) BUSHING FOR A WEB MATERIAL ROLL, WEB MATERIAL ROLL RETENTION ASSEMBLY AND METHOD FOR INSTALLING THE SAME

(71) Applicant: CASCADES CANADA ULC, Kingsey Falls (CA)

(72) Inventors: Richard Paré, Montréal (CA); André Quévillon, Montreal (CA); John Formon, Forsyth, GA (US)

(73) Assignee: CASCADES CANADA ULC, Kingsey Falls (CA)

( * ) Notice: Subject to any disclaimer, the term of this patent is extended or adjusted under 35 U.S.C. 154(b) by 537 days.

(21) Appl. No.: 16/295,815

(22) Filed: Mar. 7, 2019

(65) Prior Publication Data

US 2019/0276259 A1 Sep. 12, 2019

Related U.S. Application Data

(60) Provisional application No. 62/749,710, filed on Oct. 24, 2018, provisional application No. 62/640,936,
(Continued)

(51) Int. Cl.
*A47K 10/36* (2006.01)
*B65H 16/04* (2006.01)
(Continued)

(52) U.S. Cl.
CPC ..... *A47K 10/3687* (2013.01); *B65H 16/023* (2013.01); *B65H 16/04* (2013.01); *A47K 2010/3253* (2013.01); *B65H 18/28* (2013.01)

(58) Field of Classification Search
CPC .... A47K 2010/3253; A47K 2010/3675; A47K 2010/3681; A47K 2010/3863;
(Continued)

(56) References Cited

U.S. PATENT DOCUMENTS 1,055,576 A * 3/1913 Tyler ..... 242/599.4
2,699,903 A * 1/1955 Montgomery ..... A47K 10/38 242/422.4
2,707,595 A * 5/1955 Brown ..... A47K 10/3836 242/422.4
3,991,878 A * 11/1976 Serio, Jr. ..... B65D 85/672 242/596.7
(Continued)

FOREIGN PATENT DOCUMENTS

WO WO-2018127618 A1 7/2018

*Primary Examiner* — Sang K Kim
*Assistant Examiner* — Nathaniel L Adams
(74) *Attorney, Agent, or Firm* — Marshall, Gerstein & Borun LLP

(57) ABSTRACT

A bushing for a web material roll including a body sized to be fitted into the web material roll; the bushing further including a wall extending across the central cavity of the web material roll when the bushing is in the central cavity of the web material roll and defining an opening for receiving a roll support therethrough, the opening being bordered by a roll support contacting surface, the bushing having one or more bearing surfaces for contacting the roll support and supporting the web material roll, the one or more bearing surfaces including at least the roll support contacting surface bordering the opening. A web material roll, a web material roll retention assembly and a method for placing a web material roll in a web material roll dispenser are also provided.

27 Claims, 23 Drawing Sheets

Related U.S. Application Data filed on Mar. 9, 2018, provisional application No. 62/640,626, filed on Mar. 9, 2018.

(51) Int. Cl.
*B65H 16/02* (2006.01)
*B65H 18/28* (2006.01)
*A47K 10/32* (2006.01)

(58) Field of Classification Search
CPC ..... A47K 10/3662; A47K 10/3687; A47K 10/3836; A47K 10/3854; A47K 10/40; B65H 16/04; B65H 18/28; B65H 75/185
See application file for complete search history.

(56) References Cited

U.S. PATENT DOCUMENTS

| | | | | |
|---|---|---|---|---|
| 5,322,234 | A * | 6/1994 | Robert | B65H 75/185 242/596.7 |
| 5,370,339 | A * | 12/1994 | Moody | A47K 10/3836 242/573.9 |
| 5,451,013 | A * | 9/1995 | Schutz | A47K 10/3836 242/597.4 |
| 7,431,236 | B2 | 10/2008 | Larsson | |
| 8,096,495 | B2 | 1/2012 | Billman | |
| 8,511,600 | B2 | 8/2013 | Formon et al. | |
| 9,066,638 | B2 | 6/2015 | Lowery et al. | |
| 9,241,601 | B2 | 1/2016 | Case et al. | |
| 9,770,142 | B2 | 9/2017 | Ochoa, Sr. et al. | |
| 2018/0194582 | A1 | 7/2018 | Rozek et al. | |

* cited by examiner

BUSHING FOR A WEB MATERIAL ROLL, WEB MATERIAL ROLL RETENTION ASSEMBLY AND METHOD FOR INSTALLING THE SAME

PRIOR APPLICATIONS

The present application claims the benefit of the filing date of U.S. provisional patent application No. 62/640,936, filed on Mar. 9, 2018, and entitled "WEB MATERIAL DISPENSER", U.S. provisional patent application No. 62/640,626, filed on Mar. 9, 2018, and entitled "BUSHING FOR A WEB MATERIAL ROLL, WEB MATERIAL ROLL AND RETENTION ASSEMBLY", and U.S. provisional patent application No. 62/749,710, filed on Oct. 24, 2018, and entitled "BUSHING FOR A WEB MATERIAL ROLL, WEB MATERIAL ROLL AND RETENTION ASSEMBLY". The disclosure of each of these three U.S. provisional patent applications is hereby incorporated by reference in their entirety.

TECHNICAL FIELD OF THE INVENTION

The present disclosure generally relates to web material rolls and web material roll dispensers. More particularly, the disclosure relates to a bushing for a web material roll, to a web material roll including the bushing, to a web material roll retention assembly, and to a method for placing a web material roll in a web material roll dispenser.

BACKGROUND

Several types of paper roll dispensers exist in the prior art that are used to gradually provide a user of the paper roll dispenser with different types of paper rolled around an inner core. The most common of these types of paper roll dispensers dispenses paper items such as paper towels and toilet paper. These dispensers are often used in public area washrooms.

At the reading of the prior art paper roll dispensers, one can appreciate that it could be advantageous for several different reasons, notably for reasons of quality control and for reduction of maintenance and repair costs for dispensers, to develop paper roll dispensers which can only operate with paper roll products specifically designed for use in the paper dispensers, and paper roll products which can only operate with specifically designed paper dispensers.

BRIEF SUMMARY OF THE INVENTION

The present invention aims to address at least some of the above mention needs and provides a web material roll, a bushing for a web material roll, a web material roll retention assembly for a web material roll dispenser and a method for placing a web material roll in a web material roll dispenser.

According to a general aspect, there is provided a bushing for a web material roll having first and second extremities. The web material roll defines a central cavity. The web material roll is mountable to a roll support of a web material roll dispenser. The bushing comprises a body having first and second ends. The body is sized to be fitted into the first extremity of the central cavity of the web material roll. The bushing further comprises a wall extending across the central cavity of the web material roll when the bushing is in the central cavity of the web material roll, an opening being formed in the wall for receiving at least partially the roll support therethrough. The opening is bordered by a roll support contacting surface. The bushing also comprises one or more bearing surfaces for contacting the roll support and supporting the web material roll. The one or more bearing surfaces comprise at least the roll support contacting surface bordering the opening.

According to another aspect, there is provided a web material roll comprising a roll of web material defining a central cavity, the central cavity having first and second extremities, the roll of web material being mountable to a roll support of a web material roll dispenser. The web material roll further comprises a bushing at least partially inserted in said first extremity of the central cavity and comprising a body having first and second ends, the body being fitted into the first extremity of the central cavity; a wall extending across the central cavity, an opening being formed in the wall for receiving at least partially the roll support therethrough, said opening being bordered by a roll support contacting surface; and one or more bearing surfaces for contacting the roll support and supporting the roll of web material, said one or more bearing surfaces comprising at least the roll support contacting surface bordering the opening.

According to yet another aspect, there is provided a web material roll retention assembly for a web material roll dispenser, the assembly comprising a roll support for supporting one extremity of a web material roll defining a central cavity and having first and second extremities. The roll support includes a first portion proximate to a housing of the web material dispenser; a free end, opposite the housing of the web material dispenser; and a second portion extending between the free end and the first portion, the second portion having a smaller cross-section than a cross-section of the first portion. The assembly further comprises a bushing comprising a body having first and second ends, the body being sized to be fitted into the first extremity of the central cavity of the web material roll; a wall extending across the central cavity of the web material roll when the bushing is in the central cavity of the web material roll, an opening being formed in the wall for receiving at least partially the roll support therethrough, said opening being bordered by a roll support contacting surface; and one or more bearing surfaces for contacting the roll support and supporting the web material roll, said one or more bearing surfaces comprising at least the roll support contacting surface bordering the opening.

According to another aspect, there is provided a material roll dispenser comprising a housing; and a web material roll retention assembly according to the present disclosure. The web material roll retention assembly is engaged to the housing.

According to another aspect, there is provided a method for placing a web material roll in a web material roll dispenser, the web material roll dispenser having a roll support with first and second portions, the web material roll having a central cavity and first and second extremities. The method comprises the step of providing a bushing comprising a body having first and second ends; a wall with an opening formed therein, said opening being bordered by a roll support contacting surface; and one or more bearing surfaces comprising at least the roll support contacting surface bordering the opening. The method further comprises inserting the bushing in the central cavity of the web material roll, the first end of the body of the bushing being proximate to said first extremity of the web material roll; inserting the roll support in the body of the bushing, from the first end of the body toward the second end; and forcing the free end of the roll support within the opening of the wall, thereby engaging the one or more bearing surfaces of the bushing with at least one of the first and second portions of the roll support.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

DETAILED DESCRIPTION

Figure 1:
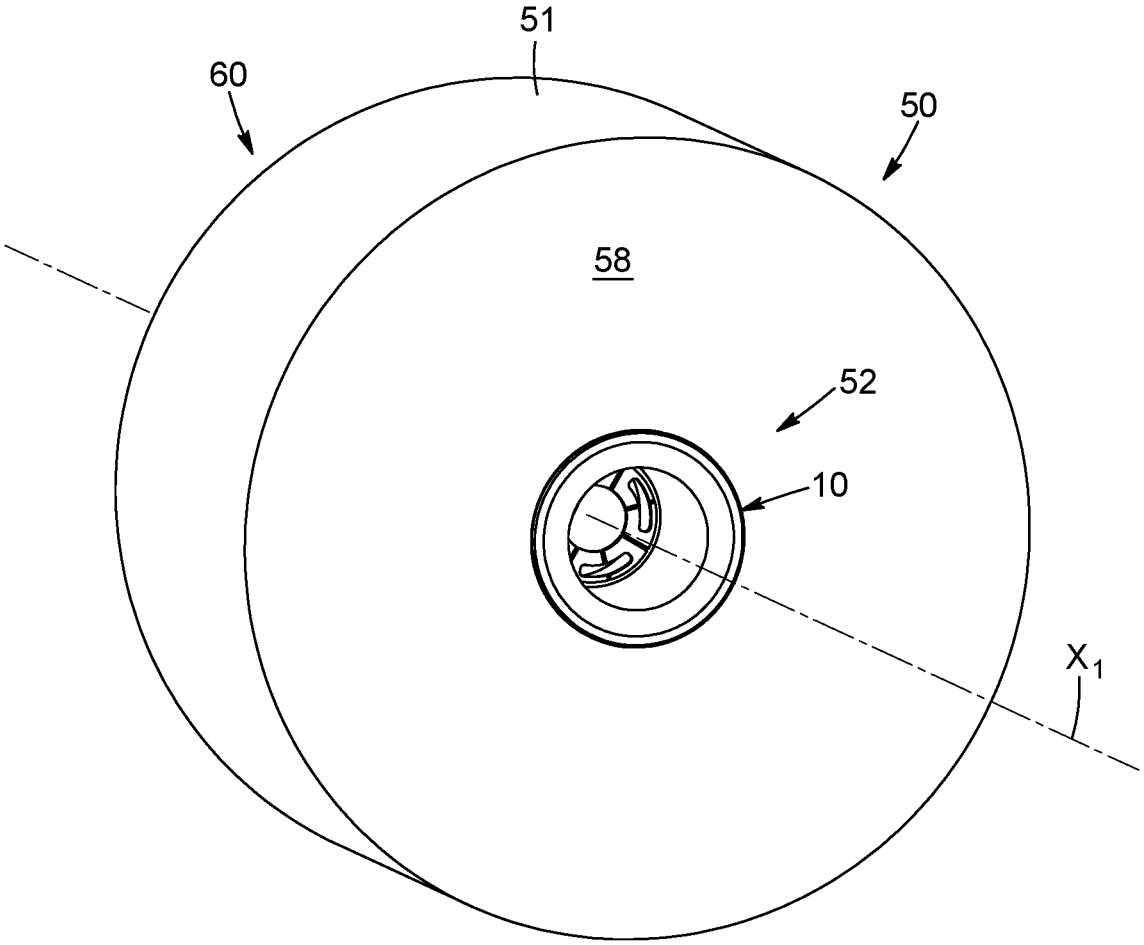
FIG. 1 is a side perspective view of a web material roll comprising a bushing in accordance with a possible embodiment of the invention.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "forward", "rearward" "left", "right" and the like should, unless otherwise indicated, be taken in the context of the figures and correspond to the position and orientation of the web material roll and corresponding parts when being mounted on a roll support of a web material roll dispenser.

The terms "inner", "interior" and "outer" should be understood as being relative to the central cavity of the web material roll. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, the term "about" means within an acceptable error range for the particular value as determined by one of ordinary skill in the art, which will depend in part on how the value is measured or determined, i.e. the limitations of the measurement system. It is commonly accepted that a 10% precision measure is acceptable and encompasses the term "about".

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not to be construed as limited to only one of that element.

It is to be understood that where the specification states that a component, feature, structure, or characteristic "may", "might", "can" or "could" be included, that particular component, feature, structure, or characteristic is not required to be included.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Figure 2:
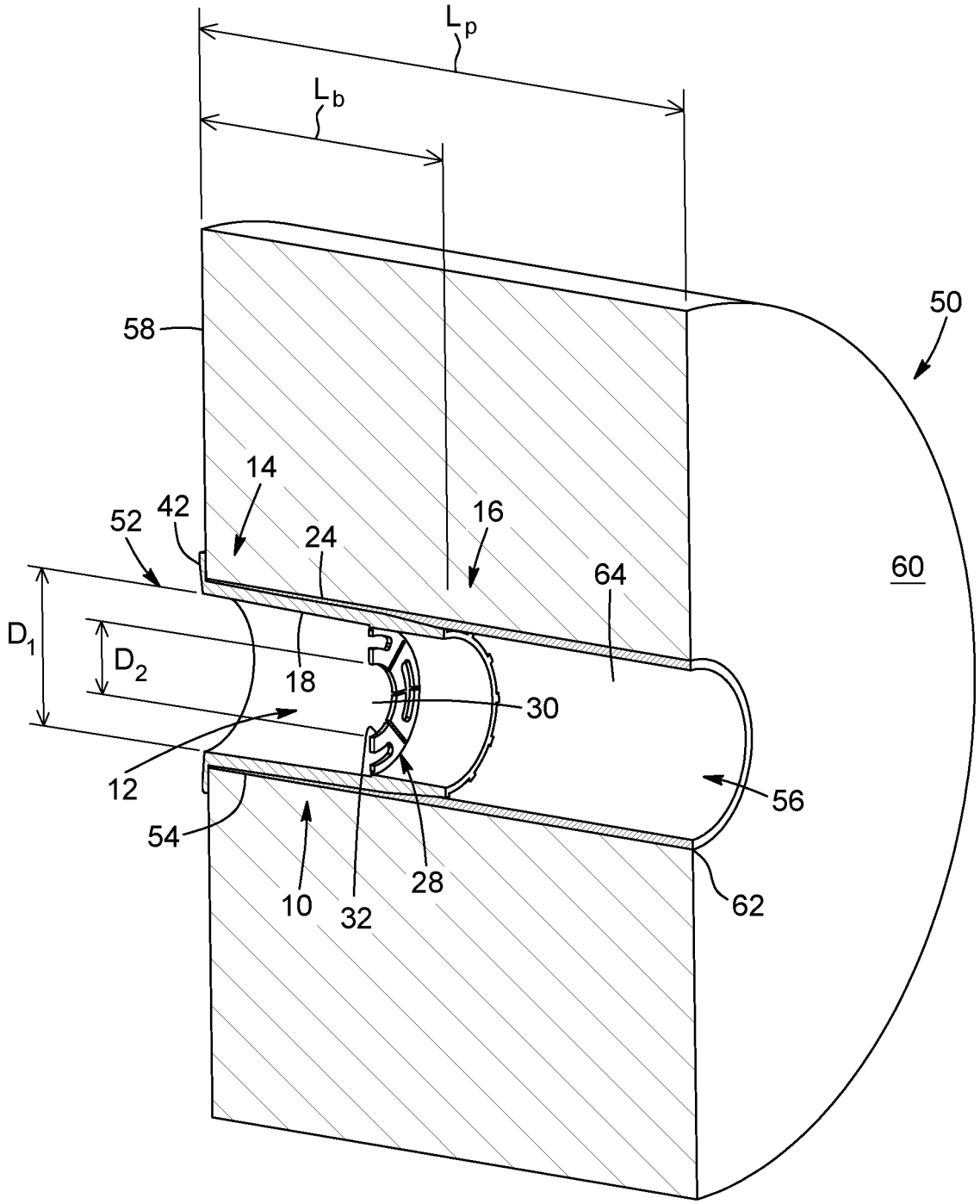
FIG. 2 is a perspective cross-section view of the web material roll of FIG. 1.
Figure 3:
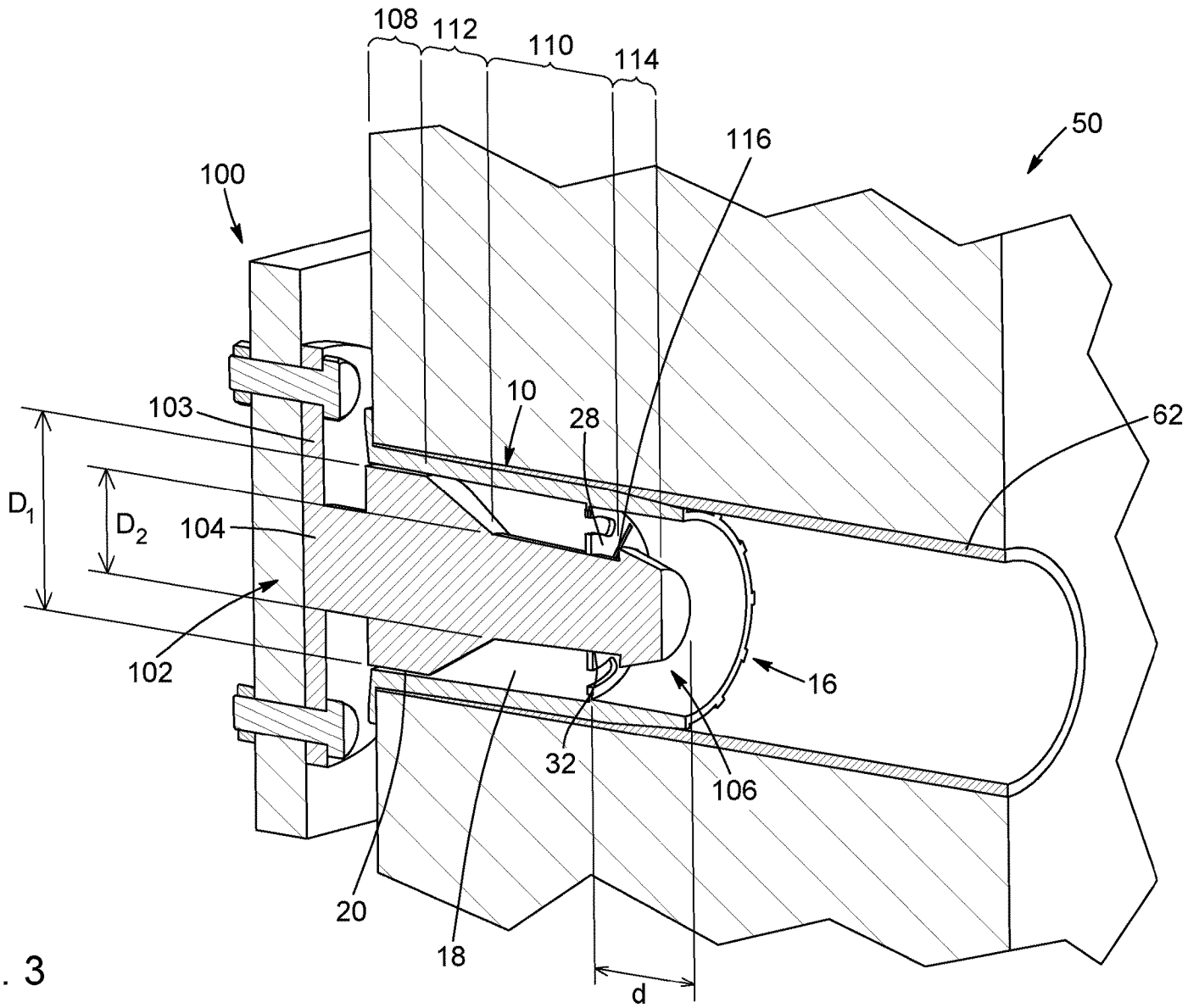
FIG. 3 is a perspective cross-section view of the web material roll of FIG. 1, the bushing being supported on a roll support of a web material roll dispenser.
Figure 4A:
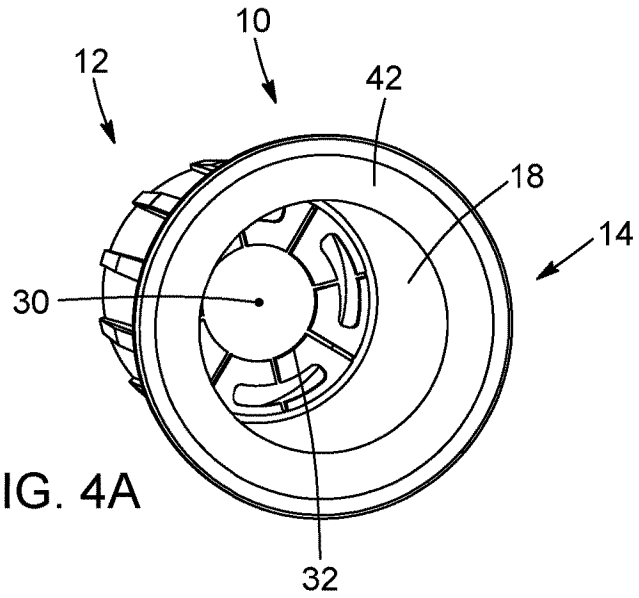
FIGS. 4A to 4G are different views of the bushing of FIG. 1.
Figure 4B:
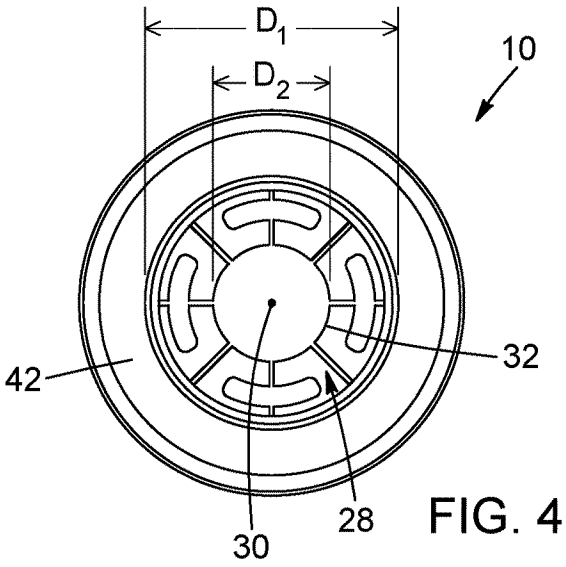
Figure 4C:
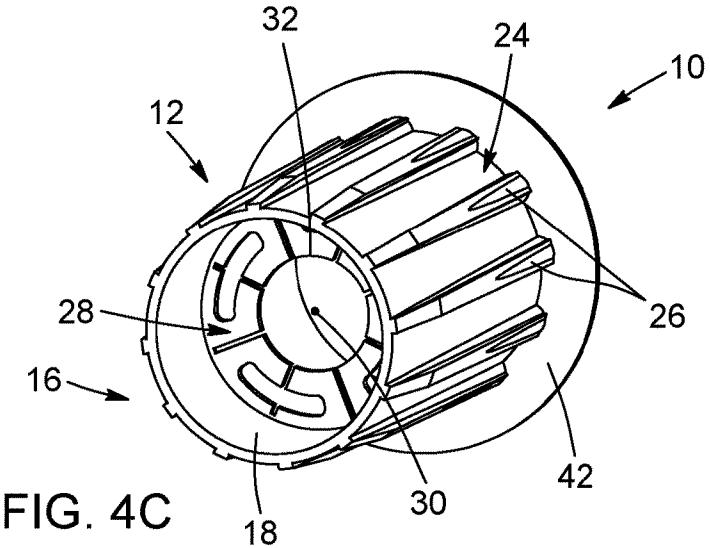
Figure 4D:
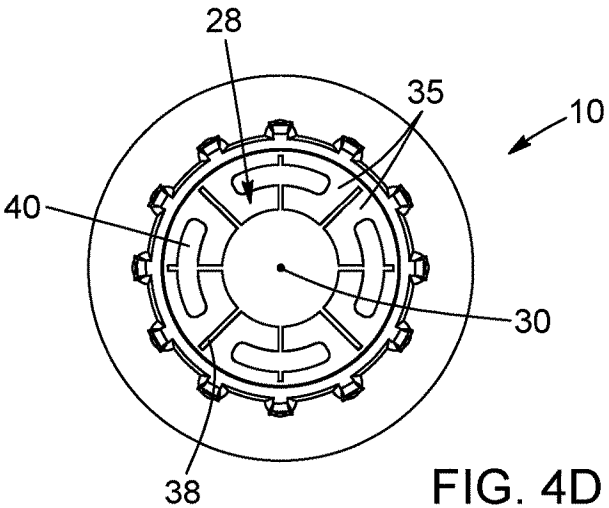
Figure 4F:
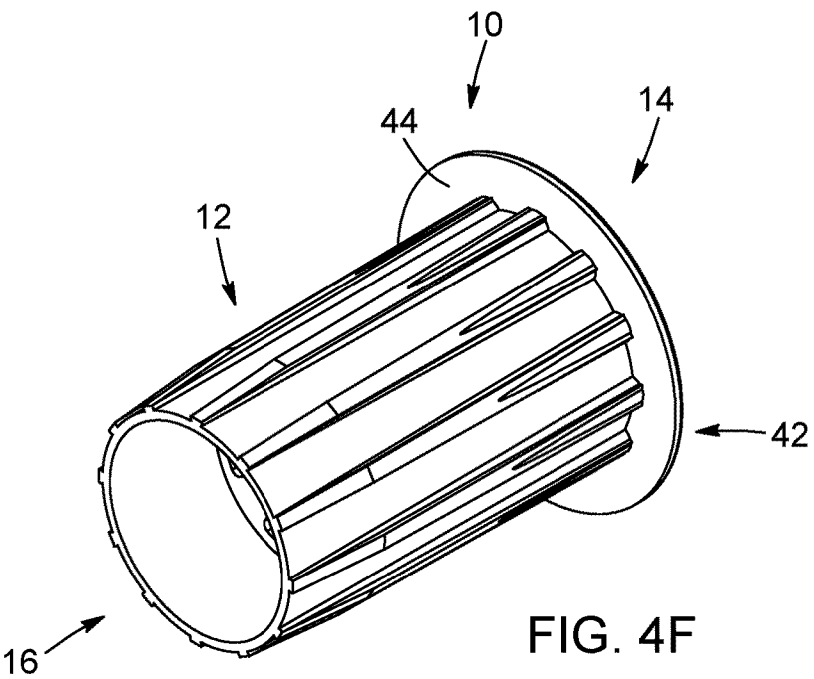
Figure 4E:
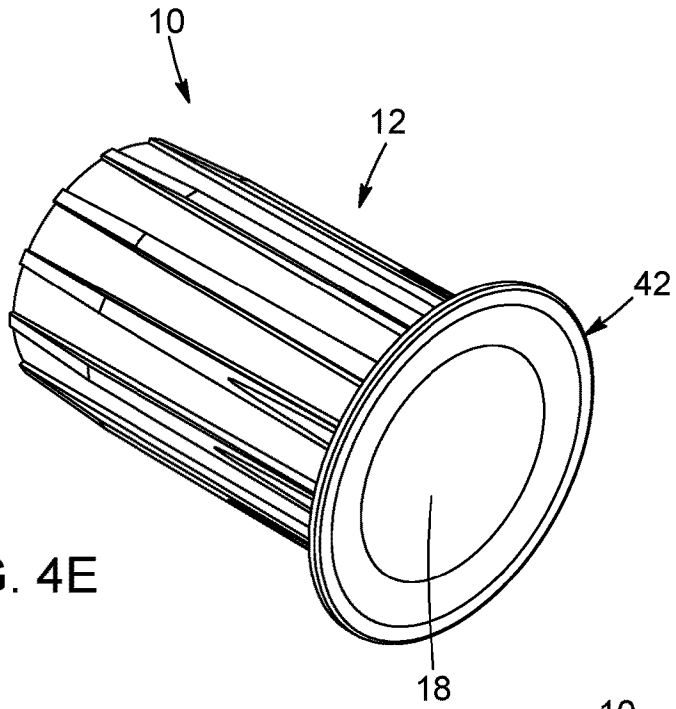
Figure 4G:
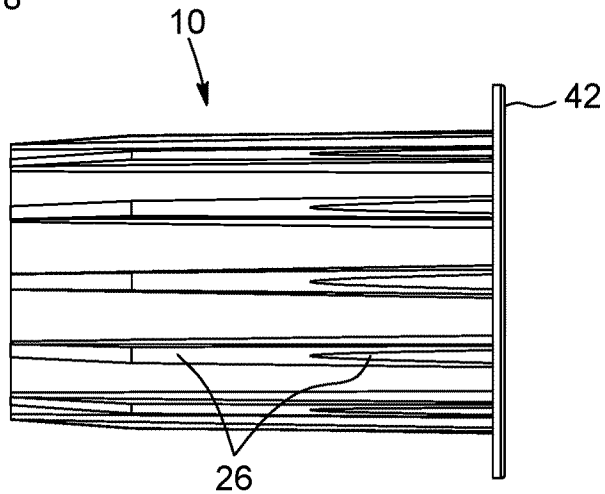

Referring now to the drawings, and more particularly to FIGS. 1 to 3, there is shown a web material roll 50 comprising a roll of web material 51 defining a central axis X1 and a central cavity 64. The central cavity 64 has first and second opposed extremities 52, 56. The rolled web material 51 defines first and second opposed lateral sides 58, 60 that extend, in this embodiment, substantially parallel to each other in substantially vertical planes at the first and second extremities of the central cavity 64. In the embodiment shown, the opposed lateral sides 58, 60 extend substantially perpendicularly to the central axis X1.

In the shown embodiment, the web material roll 50 further comprises a hollow central core 62 inserted in the central cavity 64, typically a cardboard core, around which the web material is rolled.

Even though the hollow core 62 might be useful to help and maintain the shape and dimensions of the central cavity 64 of the web material roll 50, it could be conceived a web material roll 50 in which the central cavity 64 would only be defined by the roll of web material 51. Such web material rolls are sometimes referred to as "coreless" rolls.

The first extremity 52 of the web material roll 50 has an interior surface 54 that is either defined by an interior surface of the hollow core 62, or that is defined by the innermost layer of the web material 51, when the web material roll 50 is of the coreless type.

The web material roll 50 can be a toilet web material roll, a hand towel web material roll, or any other type of rolled paper or more globally any other type of rolled web material product.

Still referring to FIGS. 1 to 3, the web material roll 50 illustrated is a toilet/hygienic paper roll, comprising a bushing 10 inserted therein. This embodiment of a bushing is only one of many possible other configurations of bushings that can be implemented according to the present invention. In this case, the bushing 10 is inserted in the first extremity 52 of the central cavity 64 of the web material roll 50. In this example, the bushing is made from a single piece, but it could also be conceived a bushing made from several assembled pieces. In this example, a single bushing is inserted at one of the extremities of the web material roll, but in other applications, such as for hand towel dispensers and/or for web material rolls of greater dimensions, it is possible to have two bushings, one bushing being inserted in each of the two extremities of the web material roll (i.e. first and second bushings inserted respectively in the first and second extremities of the central cavity).

When inserted into the web material roll 50, the bushing 10 defines a central axis that substantially coincides with the central axis X1 of the web material roll 50. In other words, when the bushing 10 is inserted in the web material roll 50, the central axis of the bushing 10 is preferably substantially coaxial with the central axis X1 of the web material roll 50.

As best shown in FIG. 2, the bushing 10 has a length Lb and the web material roll has a length Lp, both considered along the central axis X1. The ratio of the axial length Lb of the bushing 10 over the axial length Lp of the web material roll 50 is preferably between about 10% and about 100%. In another embodiment, the ratio is between about 20% and about 80%. In still another embodiment, the ratio is between about 30% and about 60%.

Referring now to FIGS. 4A to 4G, the first embodiment of the bushing 10 comprises a body 12 having first and second ends 14, 16 and an inner surface 18. In the shown embodiment, the body 12 has a substantially cylindrical shape, but it should be understood that the body 12 of the bushing 10 can have any other shape as long as the body 12 is dimensioned and shaped for the bushing 10 to be at least partially inserted in one of the extremities of the web material roll 50.

It is understood that the cylindrical body 12 of the bushing 10 is sized and configured to be fitted into the first extremity 52 of the web material roll 50, the first end 14 of the cylindrical body 12 being proximate to the first extremity 52 of the web material roll 50 when the bushing 10 is inserted in the web material roll 50. In the first illustrated embodiment, the cylindrical body 12 is formed by a continuous sidewall, but in other possible embodiments, the cylindrical body 12 can be openwork, perforated or discontinuous. An outer diameter of the cylindrical body 12 is thus similar or slightly smaller than an inner diameter of the central cavity 64 of the web material roll 50.

In this embodiment of the bushing, the cylindrical body 12 has its outer surface 24 provided with a plurality of ribs 26 extending longitudinally, in a substantially parallel manner (i.e. along directions substantially parallel to the central axis X1 of the web material roll 50 when the bushing 10 in inserted therein). The ribs 26 are for engaging the interior surface 54 of the first extremity 52 of the web material roll 50 so as to snugly fit the bushing 10 into the web material roll 50. The bushing 10 is thus snugly fitted either into the hollow core 62, or in direct contact with the innermost layer of the web material 51 of the web material roll 50. Of course, the ribs are optional. They could be replaced by small projections or protrusions, and can be simply omitted. They may also have a different configuration than parallel, linear protrusions.

It is thus understood that the bushing 10 is configured to be mounted in at least one of the extremities of the web material roll 50 so that the bushing 10 cannot rotate relative to the web material roll 50 around the central axis X1 once in place. In other words, the body 12 of the bushing 10 is dimensioned so that, when the bushing 10 is at least partially inserted into one of the extremities of the web material roll 50, the bushing 10 and the web material roll 50 are fitted in such a way that the rotation of the bushing 10 relative to central cavity 64 of the web material roll 50 is substantially prevented.

As represented in FIGS. 4A to 4G, the bushing 10 may further comprise an outside collar 42 extending from and encircling the first end 14 of the cylindrical body 12. As represented in FIGS. 2 and 3, when the bushing 10 is inserted into the first extremity 52 of the web material roll 50, the outside collar 42 abuts the first lateral side 58 disposed at the first extremity 52. The outside collar 42 may help preventing the bushing 10 from being inserted too far away in the web material roll's central cavity 64. In this exemplary embodiment, the outside collar 42 of the bushing 10 comprises a planar portion 44 that is configured to conform to the first lateral side 58 of the web material roll 50 (thus extending in a plane substantially perpendicular to the central axis X1 of the web material roll 50 when the bushing 10 is inserted in the central cavity 64 thereof), to improve fitting/cooperation of the bushing 10 with the web material roll 50.

Of course, the outside collar 42 can take other configurations, and can be replaced with one or more small tabs or "stopping elements" instead of a continuous circular collar. The collar/stopping element is optional and can be omitted.

The bushing 10 further comprises a wall 28 that is configured to extend, when the bushing 10 is at least partially inserted in the web material roll 50, across the central cavity 64 of the web material roll 50. In the embodiment shown, and as represented in FIG. 3, the wall 28 extends substantially perpendicularly to the central axis X1 of the web material roll 50 when the bushing 10 is inserted in the central cavity 64 thereof).

In the shown embodiment, the wall 28 extends across the body 12, but it could also be conceived a bushing 10 having a wall 28 distinct and distant from the body 12.

In the shown embodiment, the wall 28 extends transversally, substantially radially, in the body 12 of the bushing 10.

An opening 30 is formed in the wall 28. In the embodiment represented for instance on FIGS. 4A to 4D, the opening 30 is a substantially circular hole, but it should be understood that the opening 30 might have any other shape. In the embodiment shown, the opening 30 is formed substantially centrally in the wall 28.

The opening 30 serves to receive a distal portion of a roll support/mandrel 102 of the web material roll dispenser. The cylindrical body 12 and the opening 30 formed in the wall 28 are preferably substantially concentric. The opening 30 comprises a roll support contacting surface 32 bordering/delineating the opening 30. Again, the roll support contacting surface 32 bordering the opening 30 does not need to be continuous, as is the case in the illustrated embodiment, since radial slots 38 formed in the wall 28 (best shown in FIG. 4D) open on said roll support contacting surface 32 bordering the opening 30.

Preferably, the wall 28 is flexible or deformable. For example, in this case, the wall 28 comprises adjacent wall partitions 35 extending radially in the cylindrical body 12 around the opening 30, the wall partitions 35 being separated from each other by the above-mentioned radial slots 38. In the embodiment shown, the wall 28 further comprises at least one aperture 40 (a plurality in the embodiment shown) that are formed in the wall partitions 35, the apertures 40 extending, in the shown embodiment, between adjacent wall partitions 35.

While in the illustrated embodiment the wall 28 is shown as being substantially continuous, with only small radial slots 38 and apertures 40 provided therein, defining the partitions 35, it is possible that the wall 28 be made of a mesh or of several radial extensions/rods, without forming a well-defined planar surface. Moreover, in this case, the wall 28 is spaced away (i.e. axially offset) from the first end 14 of the cylindrical body 12, and is located at or near the second end 16 of the cylindrical body 12, but the wall 28 can be located elsewhere along the cylindrical body 12. In the illustrated embodiment, the wall 28 extends in the cylindrical body 12 of the bushing 10 between the first and second ends 14, 16, such that the wall 28 divides the cylindrical body 12 into first and second portions on each side of the wall 28.

In the illustrated embodiment, the cylindrical body 12 and the wall 28 are integrally formed as a single component. However, they could be formed of two or more distinct elements fixedly secured together.

As best shown in FIG. 3, the inner surface 18 of the cylindrical body 12 located at or near the first end 14 of the bushing 10 defines a first bearing surface 20 (in other words, in the embodiment shown, the first bearing surface 20 is located at or near the first end 14 of the body 12). This first bearing surface 20 corresponds to a ring having a width corresponding to the width (considered along the central axis X1 of the web material roll 50 when the web material roll 50 is supported on the roll support) of a first portion 108 (for instance substantially cylindrical) of the roll support/mandrel 102 and is for rotation against the first portion of the roll support 102. In the shown embodiment, this first bearing surface 20 is a first annular region having a first diameter D1. Still referring to FIG. 3, the roll support contacting surface 32 of the opening 30 formed in the wall 28 defines a second bearing surface, devised to contact/slide against a narrower, second portion 110 (for instance substantially cylindrical) of the roll support 102. In other words, the second bearing surface substantially corresponds to the roll support contacting surface 32 bordering the opening 30 formed in the wall 28. In the embodiment shown, the roll support contacting surface e 32 is a rim that forms the second bearing surface for rotation against the second portion 110 of the roll support 102. This second bearing surface of the bushing 10 has a second diameter D2, the second diameter D2 being smaller than the first diameter D1.

The term "bearing surface" should thus be understood as a surface of the bushing 10 that is configured to cooperate—directly or indirectly, for instance via a washer or any other component arranged on an outer surface of the roll support 102—with the roll support/mandrel 102. It is understood that the bushing 10 and the roll support 102 are either configured so that they can rotate relative to each other around the central axis X1 of the web material roll 50 when the web material roll 50 with the bushing 10 inserted in one of its extremities 52, 56 is supported on the roll support 102, or the bushing 10 and the roll support 102 are configured to cooperate so that the web material roll 50 in which the bushing 10 is inserted is fixedly supported by the roll support 102. In other words, the bearing surfaces of the bushing 10 are not necessarily configured so that the bushing 10 can rotate relative to the roll support 102 about the central axis X1 when the web material roll 50 in which the bushing 10 is inserted is supported by the roll support 102.

According to possible embodiments, the diameter D1 of the first bearing surface 20 is between about 5% and about 130% greater than the second diameter D2 of the second bearing surface (corresponding to the roll support contacting surface 32). Yet in preferred embodiments, the first diameter D1 is between about 20% to about 80% greater than the second diameter D2. Yet in other possible embodiments of the bushing 10, the first diameter D1 is between about 10 mm and about 50 mm and the second diameter D2 is between about 5 mm and about 25 mm. In another embodiment, the first diameter D1 is between about 15 mm and about 30 mm and the second diameter D2 is between about 10 mm and about 20 mm.

As can be appreciated from FIG. 3, the extremity 52 of the web material roll 50 into which the bushing 10 is snugly-fitted is supported by the roll support 102 of a web material roll dispenser 100. In the illustrated embodiment, the roll support 102 comprises a mandrel, but other configurations are possible.

Figure 5:
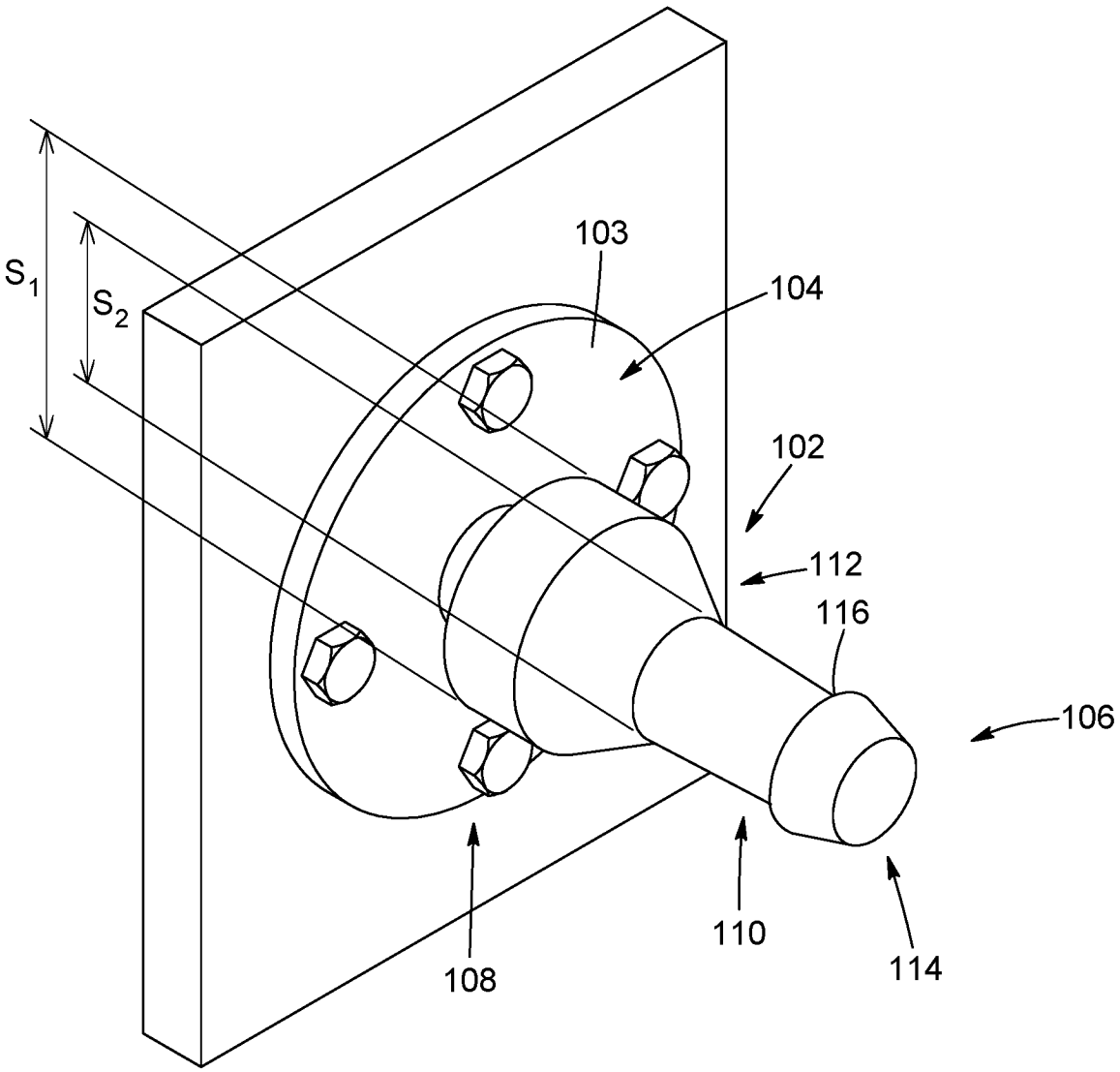
FIG. 5 is a side perspective view of the roll support of FIG. 3, according to a possible embodiment.

Referring now to FIG. 5, a possible embodiment of a roll support 102 is illustrated. The roll support 102 includes a mounting base 103 operatively connectable to the web material roll dispenser 100 (i.e. mountable to a housing of a web material dispenser), the mounting base 103 defining a first end 104 of the roll support 102. The roll support 102 further comprises an engageable portion 105 having a free end 106 opposite the mounting base 103 (i.e. opposite a housing of a web material dispenser). The mounting base can include one or more assembled components and allows connecting the roll support/mandrel to the housing, frame and/or lateral sides of the web material roll dispenser 100. The roll support 102 is thus fixedly mountable to a housing of a web material dispenser. In the embodiment shown, a distance between the mounting base 103 and the free end 106 of the roll support 102 is greater than a distance between the first end 14 of the body 16 and the wall 28. In the embodiment shown, the distance between the mounting base 103 and the free end 106 is similar to or greater than the distance between the first and second ends 14, 16 of the body 12.

The engageable portion 105 of the roll support 102, in this case, comprises the above-mentioned first/proximate portion 108 located near the mounting base 103 (i.e. proximate to a housing of a web material dispenser), this first portion 108 having a first support diameter S1. The engageable portion 105 of the roll support 102 also comprises the above-mentioned second/distal portion 110, located near the free end 106, the second portion 110 having a second support diameter S2. In the illustrated embodiment, the first and the second portions 108, 110 of the engageable portion 105 of the roll support 102 are both substantially cylindrical. The second support diameter S2 is smaller than the first support diameter S1.

The engageable portion 105 of the roll support 102 further comprises a central portion 112 located between the first and second portions 108, 110, the central portion 112 having, in the shown embodiment, a substantially truncated cone shape. Of course, other configurations of mandrels are possible: what is needed is a mandrel having an engageable portion with a proximate portion/section that has a diameter greater than the diameter of the distal portion, such that insertion of a web material roll that is not provided with a bushing will not be properly maintained over the roll support 102/mandrel.

As represented for instance in FIGS. 3 and 5, the roll support 102 further comprises a head 114 located at the free end 106 (for instance bulging at the free end 106), a shoulder 116 being formed between the second portion 108 and the head 114. In the shown embodiment, the head 114 is tapered/angled toward the tip/free end of the mandrel. Again here, other configurations for the head are possible, such as a semi-spherical or spherical/ball-shaped configuration for example. An abutment is thus formed that extends between a front end of the second portion 108 and the head 114.

Now turning back to FIG. 3, the roll support 102 is sized and configured to cooperate with the bushing 10 inserted in the web material roll 50 to support the web material roll 50 in the web material roll dispenser 100.

Once the bushing 10 has been fitted in the central cavity 64 of the web material roll 50, as represented on FIGS. 1 and 2, the roll support 102 can be inserted into the cylindrical body 12 of the bushing 10, from the first end 14 of the cylindrical body 12 toward the second end 16. The free end 106 of the roll support 102 is introduced into the cylindrical body 12 toward the second end 16, the free end 106 being forced within the opening 30 of the wall 28.

The forcing of the free end 106 within the opening 30 of the wall 28 is made possible thanks to the deformability and/or flexibility of the wall 28, and is facilitated by the tapered/angled configuration of the head 114 and/or by the radial slots 38 and/or apertures 40 formed in the wall 28. The wall 28 is flexible or deformable so that it allows the passage of the roll support 102 through the opening 30 when the web material roll 50 is placed on the roll support 102.

When the free end 106 of the roll support 102 is introduced into the cylindrical body 12, the head 114 of the roll support 102 is introduced into the opening 30 of the wall 28. The tapered shape of the head 114 is oriented so that the cross-section of the head 114 decreases toward the free end 106 of the roll support 102. It is thus understood that the head 114 is configured so that the head 114 progressively deforms the wall partitions 35 of the wall 28. In other words, the free end 106 of the roll support 102 has at least one region with a cross-section that is greater than the cross-section of the opening 30 defined in the bushing 10.

Once the whole length of the head 114 has been passed through the opening 30 of the wall 28, the wall partitions 35 of the wall 28 take back their initial substantially radial orientation. In the embodiment shown, the repositioning of the wall 28/wall partitions 35 that had been momentarily deformed by the free end 106 of the roll support 102 generates an audible indication that gives to the user an indication that the web material roll 50 has been properly installed on the roll support 102 of the web material roll dispenser 100. In other words, the bushing 10 generates a clicking sound resulting from forcing the free end (106) of the roll support into the opening of the bushing, momentarily deforming the wall of the bushing, upon the head of the roll support 102/mandrel being inserted in the bushing 10. The frangible/movable wall partitions are thus "sound generators", the sound being generated by the interaction of the flexible wall 28 with the second portion 108 of the roll support 102. In yet other words, the bushing 10 is configured so that insertion of the roll support 102 within the opening 30 of the bushing 10 generates an audible indication of proper installation of the web material roll on the roll support.

The method for placing the web material roll 50 in the web material roll dispenser 100 thus comprises a step of confirming proper insertion of the web material roll 50 onto the roll support 102, when the clicking sound generated by the passage of the roll support 102 into the cavity or hole 30 of the bushing 10 is detected.

Once the head 106 has been passed through the hole 30 of the bushing 10, the first and second bearing surfaces 20, 32 of the bushing 10 respectively cooperate with the first and second portions 108, 110 of the roll support 102. It is understood that the first and second support diameters S1, S2 defined respectively by the first and second portions 108, 110 of the roll support 102 substantially correspond respectively to the first and second diameters D1, D2 of the first and second bearing surfaces 20, 32. In the installed position of the web material roll 50 on the roll support 102, as represented for instance on FIG. 3, the free end 106 of the roll support 102 is substantially axially aligned with the second end 14 of the bushing 10, the head 114 of the roll support 102 being arranged in the portion of the cylindrical body 12 of the bushing 10 formed between the wall 28 and the second end 16.

The axial position of the head 114 of the roll support 102 relative to the bushing 10 is understood with reference to the central axis X1 of the web material roll 50.

In the shown embodiment, the first and second bearing surfaces 20, 32 are configured so that the cylindrical body 12 and the wall 28 of the bushing 10 rotate relative respectively to the first and second portions 108, 110 of the roll support 102.

In other words, the bushing 10 forms two distinct bearing surfaces that cooperate with the roll support 102, so as to increase the efficiency and the stability of the rotative mounting of the web material roll 50 relative to the roll support 102 of the web material roll dispenser 100.

The web material roll 50 is thus properly rotatably mounted to the web material roll dispenser 100 so that when a pulling force is exerted on a free end of the web material 51 of the web material roll 50, the web material roll 50 rotates around the roll support 102 about the central axis X1 so as to unwind a portion of the web material 51 of the web material roll 50.

In another embodiment (not represented), at least a portion of the roll support 102 can be rotatably mounted to the web material roll dispenser 100. For instance, the mounting base 103 of the roll support 102 can comprise a shaft cooperating with the housing of the web material roll dispenser 100, or the engageable portion 105 of the roll support 102 can be rotatably mounted to the mounting base 103 of the roll support 102, so as to rotatably mount the engageable portion 105 of the roll support 102 relatively to the housing of the web material roll dispenser 100.

In this embodiment in which at least the engageable portion 105 of the roll support 102 is rotatably mounted to the housing of the web material roll dispenser 100, the first and second bearing surfaces 20, 32 are configured so that the cylindrical body 12 and the wall 28 of the bushing 10 are fixedly supported respectively by the first and second portions 108, 110 of the roll support 102. It is thus understood that when a pulling force is exerted on a free end of the web material of the web material roll 50, the web material roll 50, the bushing 10 and the engageable portion 105 of the roll support 102 rotate together relative to the housing of the web material roll dispenser 100, around the central axis X1 of the web material roll 50, so as to unwind a portion of the web material of the web material roll 50.

The bushing 10 thus forms two distinct bearing surfaces that cooperate with the roll support 102, so as to increase the efficiency and the stability of the mounting of the web material roll 50 together with the engageable portion 105 of the roll support 102 of the web material roll dispenser 100.

It should be understood that the disclosure is not limited to a bushing having two distinct bearing surfaces. We could also conceive a bushing having a single bearing surface that would be dimensioned so as to allow an efficient and stable mounting of the web material roll 50 and the engageable portion 105 of the roll support 102.

It is understood that the at least one bearing surface ensuring the efficient and stable cooperation between the bushing 10 and the engageable portion 105 of the roll support 102 is dimensioned so as to support all the weight of the web material roll 50.

It is also understood that the bushing 10 is designed so that there is no direct contact between the web material roll 50 and the engageable portion 105 of the roll support 102 (i.e. so that there is no direct contact between the web material roll and the roll support): the engageable portion 105 of the roll support 102 and the web material roll 50 cooperate with each other via the bushing 10. In other words, the interior surface of the web material roll 50 that delimits the central cavity 64 (i.e. the interior surface of the first extremity of the central cavity) contacts solely the bushing 10, via the body 12 and/or the wall 28.

The set comprising the roll support 102 and the bushing 10 that is mounted in the web material roll 50 thus forms a web material roll retention assembly 200, the roll support 102 and the bushing 10 being dimensioned so as to cooperate with each other to ensure the proper rotatable mounting of the web material roll 50 in the web material roll dispenser 100.

In other words, the roll support 102 of the web material roll dispenser 100 is configured so that it can only properly support web material rolls that will be equipped with the bushing 10 according to the present disclosure.

As represented for instance in FIG. 3, the wall 28 is located at a distance d from the second end 16 of the body 12, the distance d being considered along the central axis X1 of the web material roll 50 when the bushing 10 is inserted in the web material roll 50.

The web material roll retention assembly 200 is at least partially defined by the first and second support diameters S1, S2 defined respectively by the first and second portions 108, 110 of the roll support 102 (and corresponding substantially respectively to the first and second diameters D1, D2 of the first and second bearing surfaces 20, 32), and by the distance d between the wall 28 and the second end of the body 12. At least these three parameters of the web material roll retention assembly 200 are set according to different types of web material rolls.

In other words, for a given set of values of the first support diameter S1, the second support diameter S2 and the distance d, corresponds a specific web material roll 50. The web material roll retention assembly 200 is thus configured so that it would not be possible to feed the web material roll dispenser 100 with an unwanted type of web material roll that would not be dimensioned to properly cooperate with the bushing 10 and the roll support 102 (i.e. with the given web material roll retention assembly 200). The different types of web material rolls can for instance correspond to different qualities and/or different compositions of wound web material.

Due to the shoulder 116 that is formed between the second portion 110 and the tapered head 114 of the roll support 102, the removal of the web material roll 50 from the roll support 102 breaks at least partially the wall 28 extending in the cylindrical body 12 of the bushing 10. In other words, the wall is frangible, allowing it to break when the web material roll 50 is removed from the roll support 102. The substantially vertically extending face formed between the second portion 110 and the tapered head 114 abuts indeed against the wall partitions 35 of the wall 28, so that when the roll support 102 is forced out of the bushing 10, the wall 28 is at least partially broken.

The bushing 10 according to the present disclosure is thus configured so that it cannot be reused after the web material roll 50 has been removed from the web material roll dispenser 100.

Figure 6B:
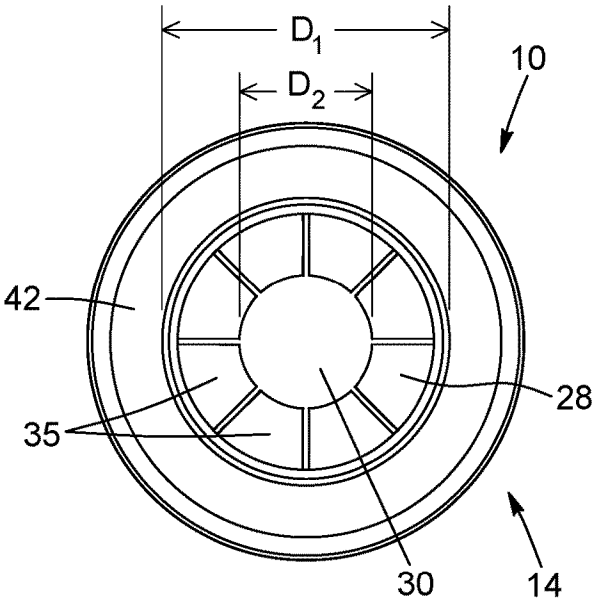
FIG. 6A to 6C are different views of a bushing in accordance with another possible embodiment, the bushing having a wall at an end of a cylindrical body.
Figure 6C:
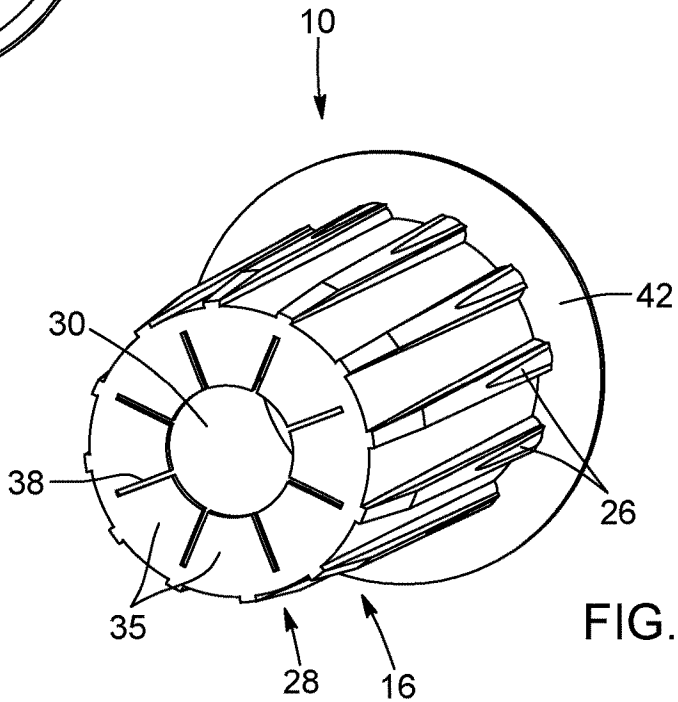
Figure 6A:
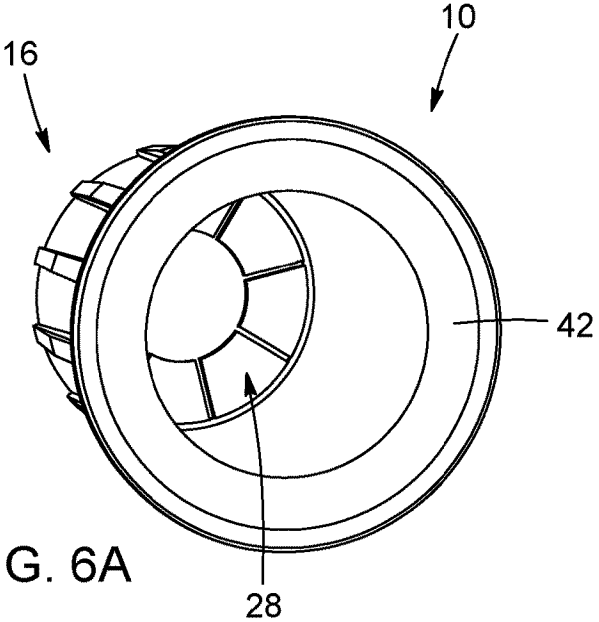
Figure 7:
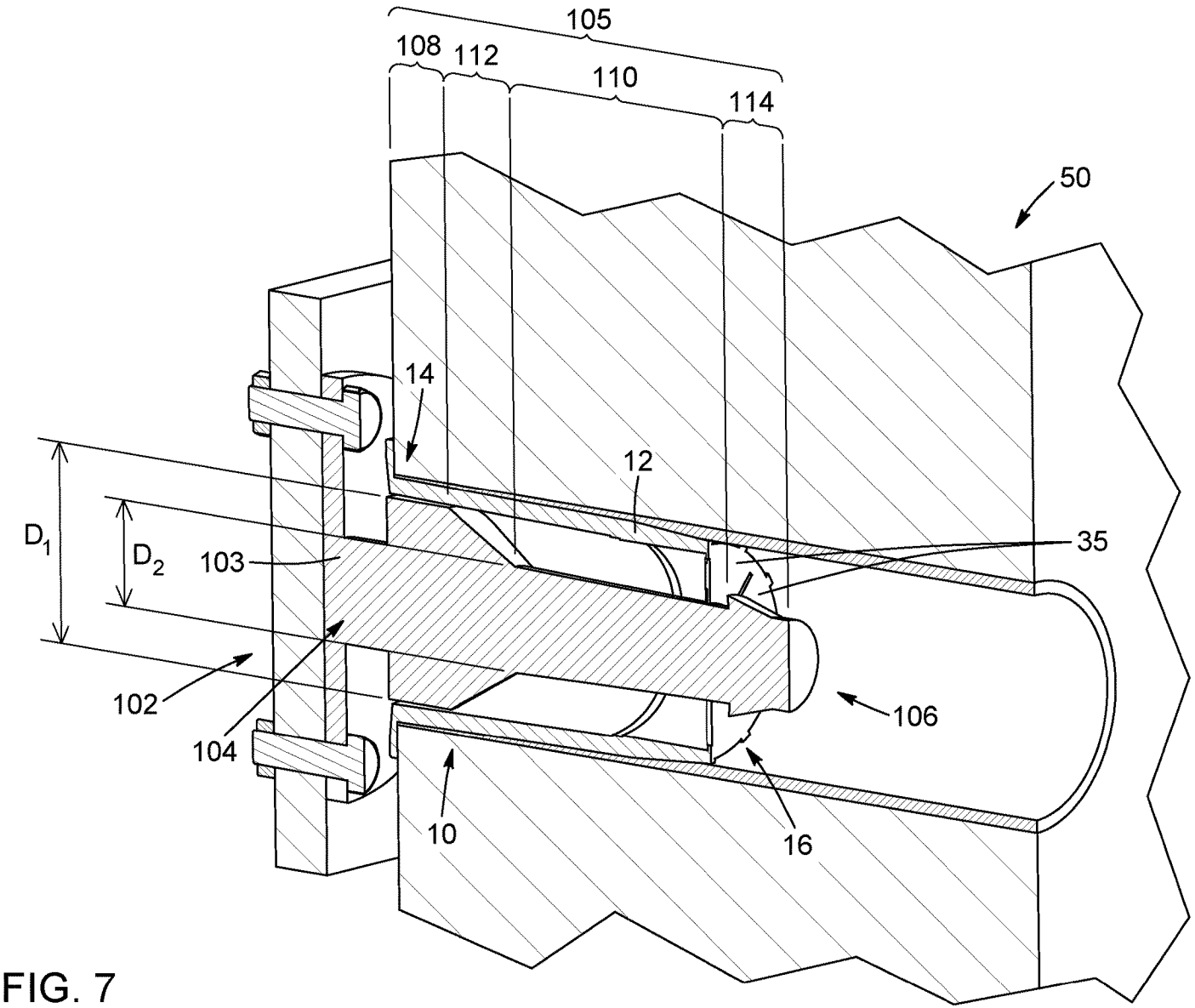
FIG. 7 is a perspective cross-section view of a web material roll comprising the bushing of FIGS. 6A to 6C, the bushing being supported on a roll support of a web material roll dispenser.

FIGS. 6A to 6C illustrate a second possible embodiment of the bushing 10. The second embodiment is different from the first one represented with reference to FIGS. 4A to 4G in that the wall 28 is formed at the second end 16 of the bushing 10. Contrary the first embodiment, the wall 28 does not divide the cylindrical body 12 into two distinct portions and no distance d is defined between the second end 16 and the wall 28.

Thus, once the web material roll 50, in the first extremity 52 of which the bushing 10 has been inserted, has been mounted on the roll support 102 of the web material roll dispenser 100, the head 114 of the roll support 102 is axially offset (considered along the central axis X1) relative to the second end 16 of the bushing 10. In other words, the second embodiment of the bushing 10 is dimensioned so that when it is inserted in the web material roll 50 and when the web material roll 50 is rotatably mounted on the roll support 102, the second end 16 of the bushing 10 (and thus the wall 28 of the bushing 10) is axially arranged between the head 114 of the roll support 102 and the second portion 110 of the roll support 102. Moreover, the second embodiment of the bushing 10 differs from the first one in that no apertures are formed in its wall partitions 35. As can be appreciated, several configurations of bushings are possible according to the present invention, and the two illustrated embodiments are only provided as examples.

Figure 8:
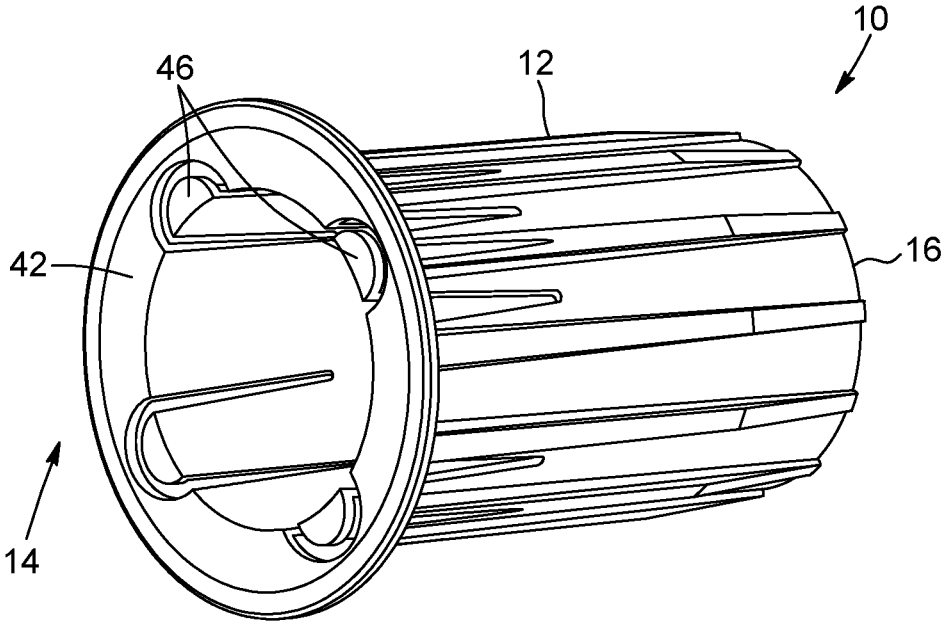
FIG. 8 is a side perspective view of a bushing in accordance with another possible embodiment, the bushing having braking fingers.
Figure 9:
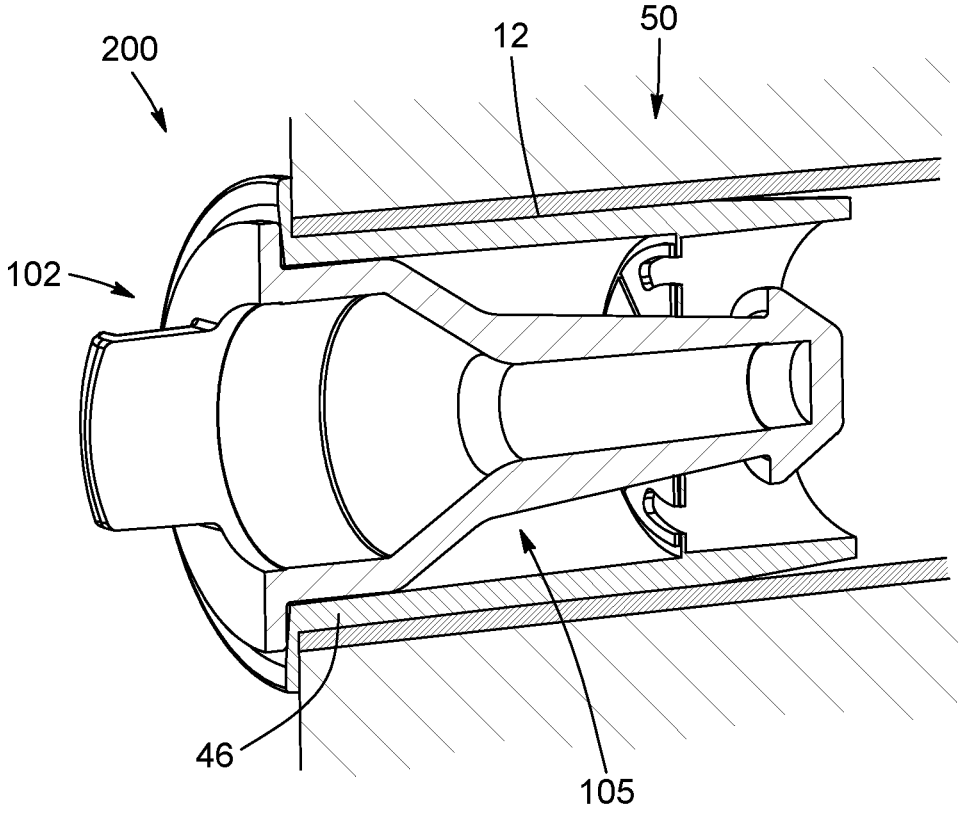
FIG. 9 is a perspective cross-section view of a web material roll in which the bushing of FIG. 8 is inserted, the web material roll and the bushing being supported on a roll support of a web material roll dispenser.

FIGS. 8 and 9 illustrate another embodiment of the bushing 10. The illustrated bushing 10 comprises a dispensing brake 46 that creates friction between the bushing 10 and the roll support 102, and more specifically friction with the engageable portion 105 of the roll support 102 when inserted in the central cavity 64 of the web material roll 50.

For instance, the dispensing brake 46 comprises braking fingers (four, in the embodiment shown, regularly spaced apart from each other) provided on the inner surface 18 of the body 12, near the first end 14. In the shown embodiment, the braking fingers 46 extend substantially longitudinally (i.e. in a direction substantially parallel to the central axis X1 of the web material roll 50) on the inner surface 18 of the body 12, so as to create friction with the engageable portion 105 of the roll support 102, in order to brake the rotation of the web material roll 50 relative to the roll support 102, when the web material roll 50 with the bushing 10 inserted in one of its extremities is rotatably mounted to the engageable portion 105 of the roll support 102. In the embodiment shown, recesses are formed in the outside collar 42 to receive a proximal end portion of the braking fingers of the dispensing brake 46. It is appreciated that the shape, the configuration, and the location of the dispensing brake, and the shape, the configuration, the location and the number of the braking fingers can vary from the embodiment shown.

Figure 10:
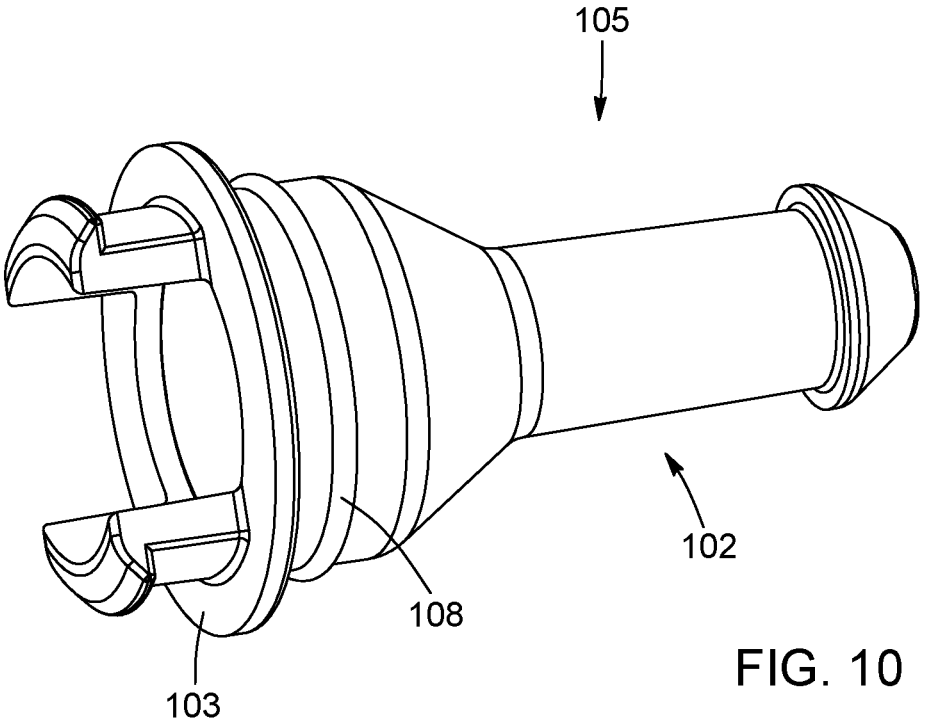
FIG. 10 is a side perspective view of a roll support in accordance with another possible embodiment.
Figure 11:
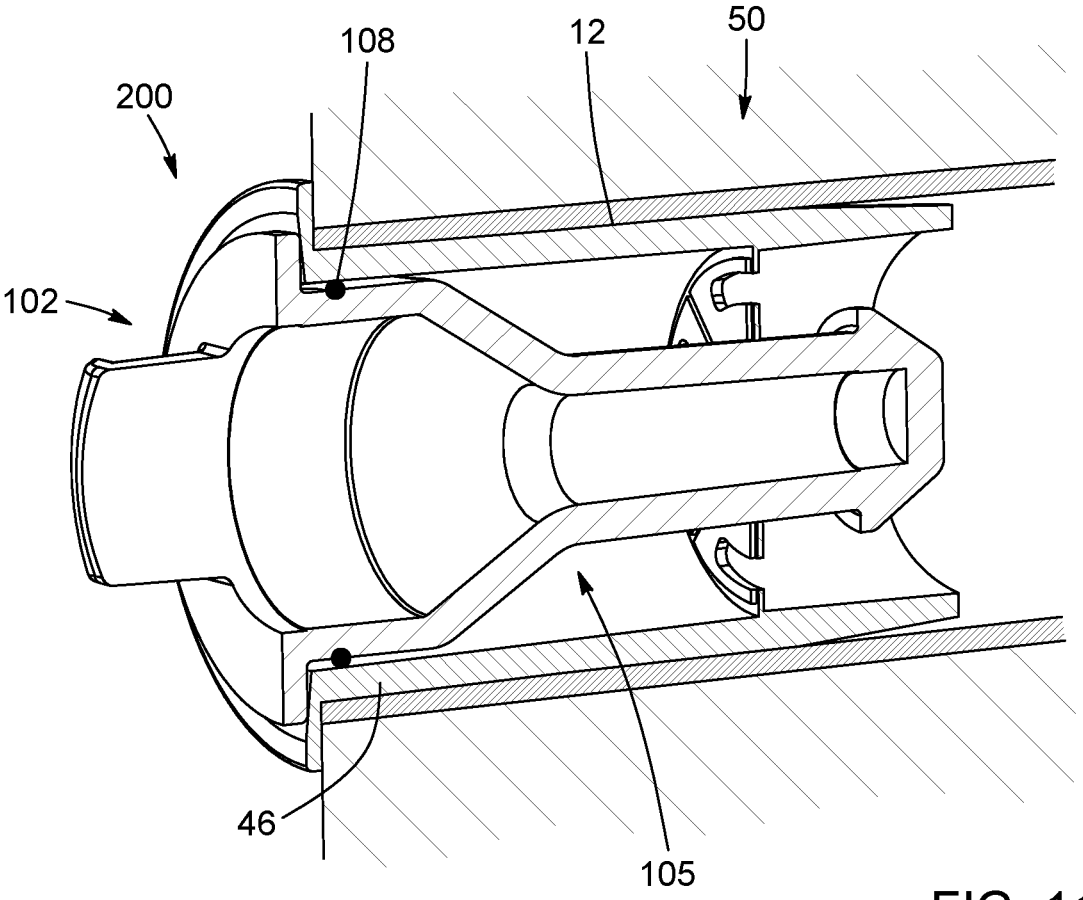
FIG. 11 is a perspective cross-section view of a web material roll having a bushing, the bushing and the web material roll being supported on the roll support of FIG. 10.
Figure 12:
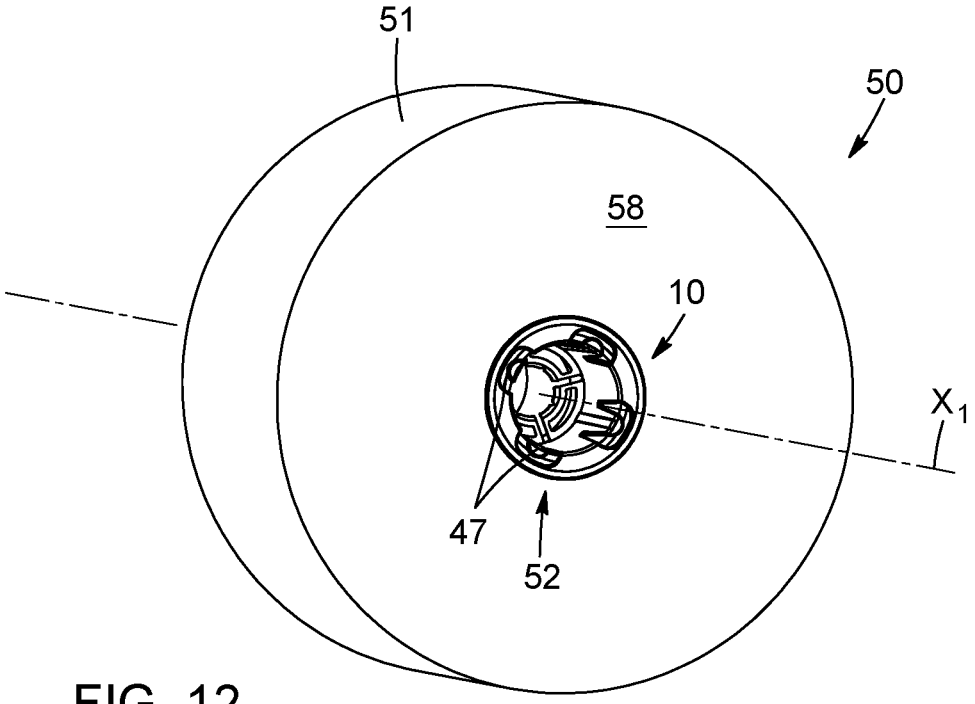
FIG. 12 is a side perspective view of a web material roll comprising a bushing in accordance with another possible embodiment of the invention.
Figure 13:
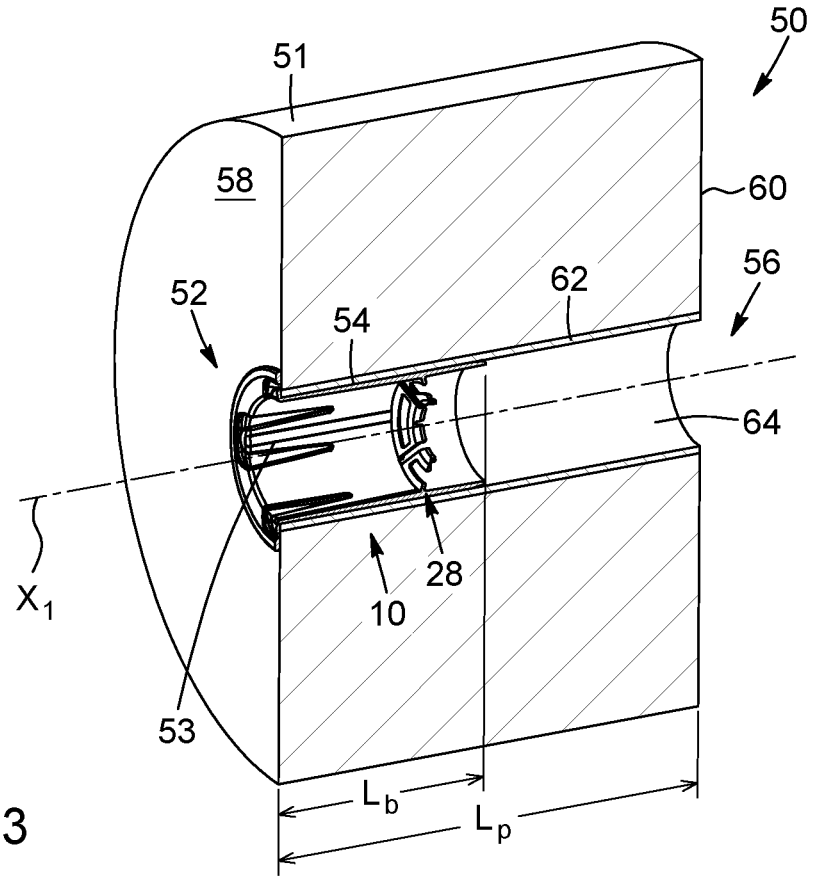
FIG. 13 is a perspective cross-section view of the web material roll of FIG. 12.
Figure 14A:
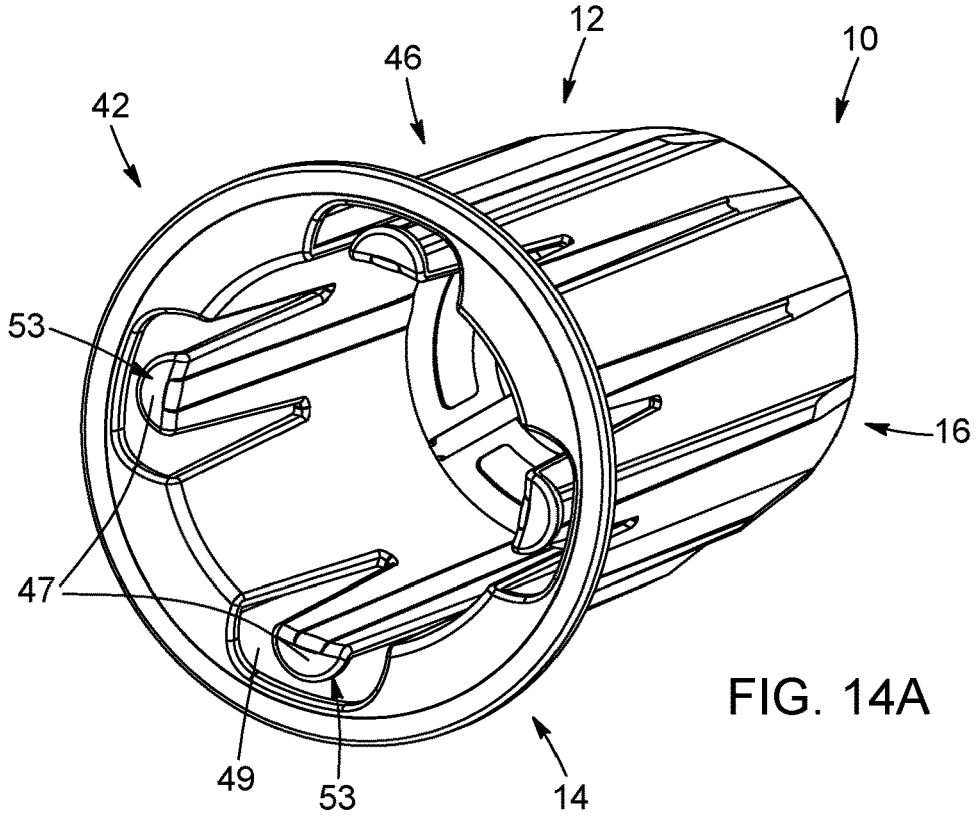
FIGS. 14A and 14B are front and rear perspective views of the bushing of FIG. 12.
Figure 14B:
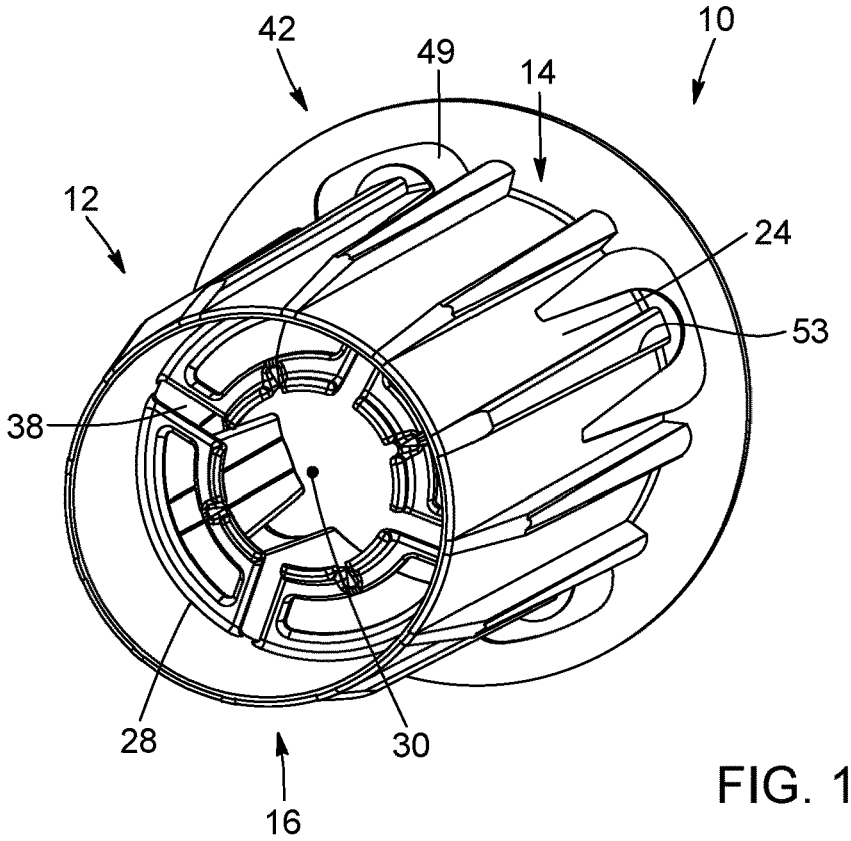
Figure 15A:
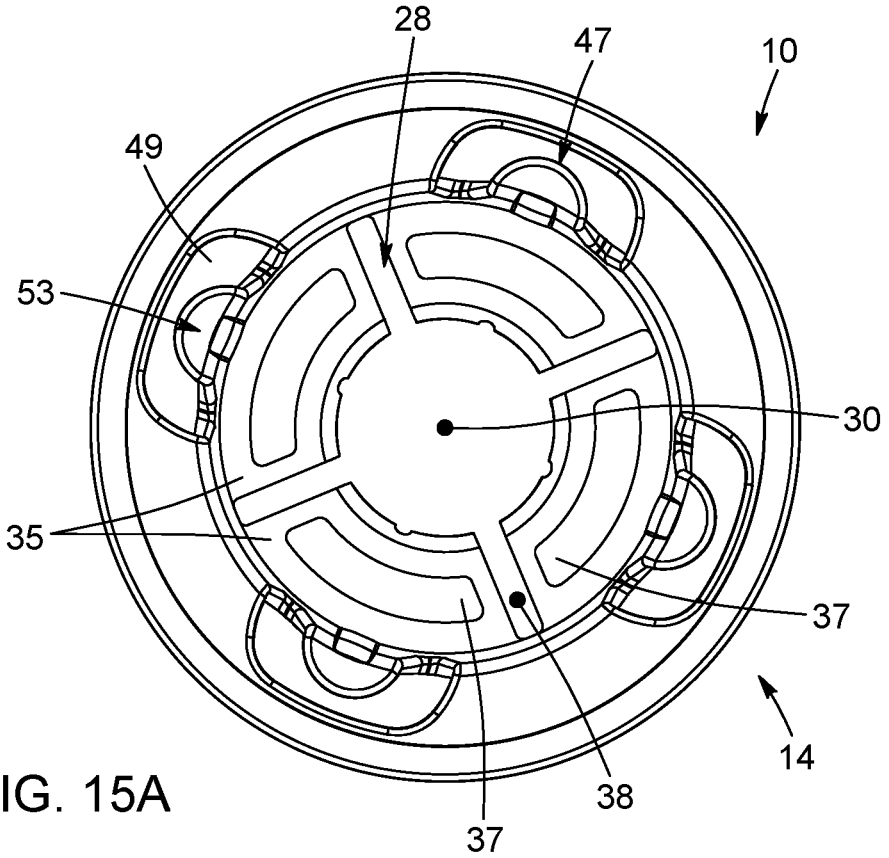
FIGS. 15A and 15B are front and rear elevation views of the bushing of FIG. 12.
Figure 15B:
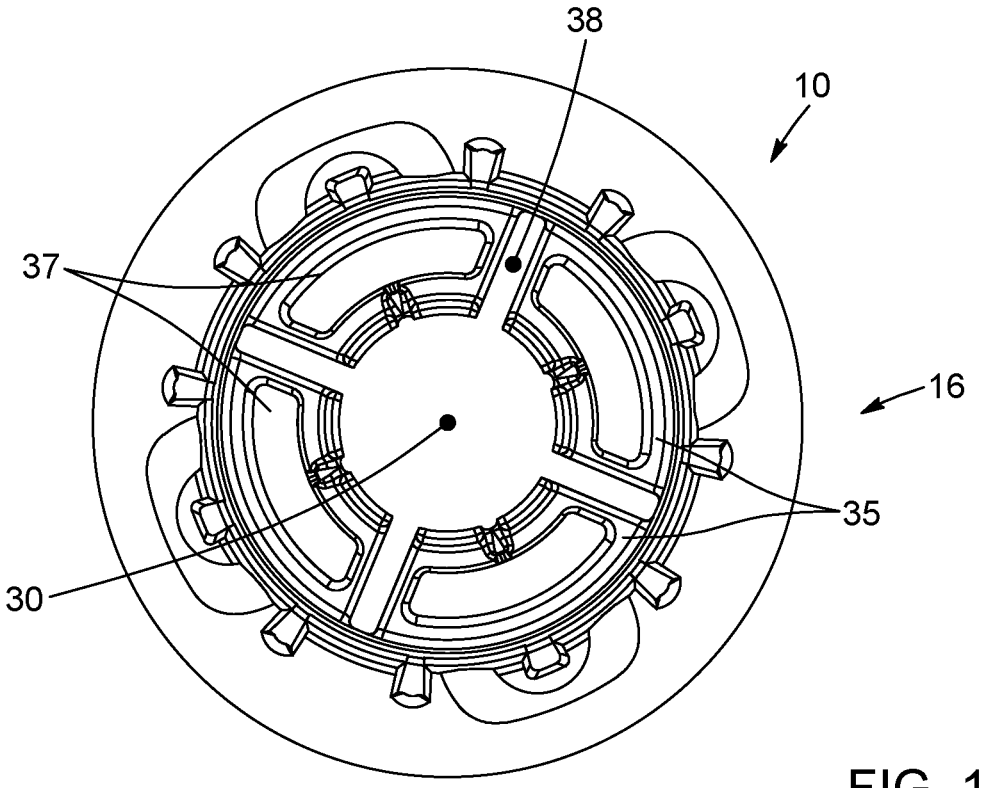

FIGS. 10 and 11 represent another embodiment of the roll support 102 that further comprises a dispensing brake 118 that creates friction between the bushing 10 and the roll support 102, and more specifically between the bushing 10 and the engageable portion 105 of the roll support 102.

In the shown embodiment, the dispensing brake 118 comprises a compressible annular band surrounding the first portion 108 of the roll support 102 in order to brake the rotation of the web material roll 50 relative to the roll support 102, when the web material roll 50 with the bushing 10 inserted in one of its extremities is rotatably mounted to the engageable portion 105 of the roll support 102. It is appreciated that the shape, the configuration, and the location of the dispensing brake 118 of roll support 102 can vary from the embodiment shown. It should be understood that the dispensing brakes 46, 118 are configured to brake the rotation of the web material roll 50 relative to the roll support 102 when the web material roll 50 is rotatably mounted to the engageable portion 105 of the roll support 102.

In the embodiment in which the web material roll 50 is fixedly supported by the engageable portion 105 of the roll support 102 and in which the engageable portion 105 is rotatably mounted to the housing of the web material roll dispenser 100, the dispensing brakes 46, 118 are configured to further improve the stable cooperation between the bushing 10 and the engageable portion 105 of the roll support 102, so as to ensure that, when a pulling force is exerted on a free end of the web material of the web material roll 50, the bushing 10 inserted in the web material roll 50 will not rotate relative to the engageable portion 105 of the roll support 102.

Referring now to FIGS. 12 to 15B, there is shown another embodiment of the bushing 10.

In the embodiment shown, the body 12 of the bushing 10 has a substantially cylindrical shape, but other shapes and configurations are possible, as long as the body 12 of the bushing 10 can be at least partially inserted in one of the extremities 52, 56 of the roll of web material 50. For instance, the bushing could be designed and configured with a body having a substantially truncated shape. In such case, the diameter of the body 12 of the bushing 10 could decrease from the first end 14 of the body 12 to the second end 16.

In the illustrated embodiment, the bushing 10 comprises a dispensing brake 46 configured to create friction between the bushing 10 and the roll support 102, and more specifically friction with the engageable portion 105 of the roll support 102 when inserted in the central cavity 64 of the web material roll 50. The dispensing brake 46 of the bushing 10 comprises a plurality of braking tabs 47 (four, in the embodiment shown, regularly spaced apart from each other) extending substantially longitudinally (i.e. in a direction substantially parallel to the central axis X1 of the web material roll 50) along the body 12 on an outer surface of the body 12, so as to create friction with the engageable portion 105 of the roll support 102. The braking tabs 47 are for engaging the interior surface of the first extremity 52 to snugly fit the bushing 10 into the web material roll 50. In this example, the bushing 10 includes four braking tabs 47, but there can be more or less of such braking tabs 47. The braking tabs 47 have a similar shape, so that the following description of one of the braking tabs 47 will apply to any of them.

A slot 49 is formed in the bushing 10, and more particularly in the junction between the body 12 and the outside collar 42 of the bushing 10, for the braking tab 47 to comprise a free end 53 (or proximal end 53) at least partially surrounded by the slot 49. The slot 49 extends on each side of the free end 53 of the braking tab 47 along a longitudinal portion of the body 12, for the free end 53 of the braking tab 47 to be radially displaceable, or at least to provide some flexibility to the braking tab 47. In the embodiment shown, the slot 49 is substantially C-shaped, but other shapes are possible. The braking tab 47 thus forms a friction area of the inner surface 18 of the body 12 of the bushing 10, contributing to a snug fit of the engageable portion 105 of the roll support 102 in the bushing 10.

Moreover, the braking tab 47 is dimensioned and shaped for the body 12 of the bushing 10 to improve the fit of the bushing 10 into the web material roll 50, and to limit the risk of an overspinning of the web material roll 50 when the web material is dispensed, given that the braking tab 47 forms a friction area or friction surface, on the outer surface 24 of the body 12 of the bushing 10.

Optionally, the free end 53 of the braking tab 47 may extend along at least about 25% of the length Lb of the bushing 10, and preferably along at least about 40% of the length Lb of the bushing 10, and still preferably, along at least about 50% of the length Lb of the bushing 10. In another embodiment, the free end 53 extends along at least about 60% of the length Lb of the bushing 10.

In the embodiment shown, the braking tab 47 is integrally formed in the body 12, but the braking tab 47 and the body 12 could also be formed of distinct elements fixedly secured together. It is appreciated that the shape, the configuration, the number and the location of the braking tabs 47 can vary from the embodiment shown.

In the embodiment shown, the wall 28 comprises a plurality of adjacent wall partitions 35 separated from each other by radial slots 38. In this example, there are four wall partitions, but there can be less or more partitions. As represented for instance in FIGS. 14A, 14B, 15B and 15B, when the bushing 10 is not mounted to the roll support 102, each wall partition 35 extends substantially perpendicularly to the inner surface 18 of the body 12 of the bushing 10. In the embodiment shown, a substantially arcuate aperture 37 is formed in each wall partition 35. It is appreciated that the shape, the configuration, the number and the location of the wall partitions 35 forming together the wall 28 can vary from the embodiment shown.

Figure 20:
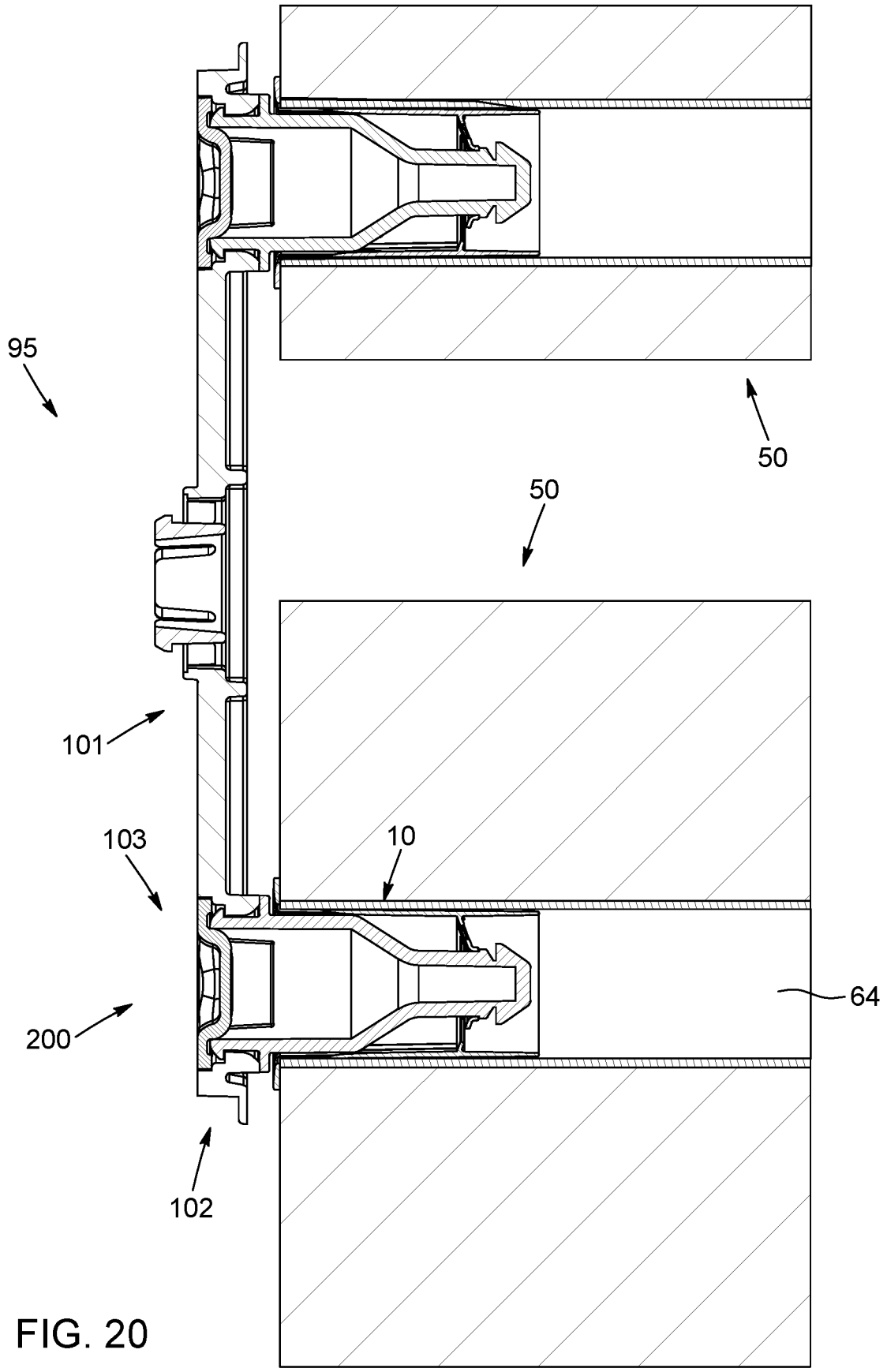
FIG. 20 is a side cross-section view of the web material roll and the bushing of FIG. 12, the bushing and the web material roll being supported on the first and second roll supports of the roll support assembly of FIG. 16.

Referring now more particularly to FIGS. 16 to 22, there is shown a roll support assembly 95 comprising a roll support mounting plate 101 having an upper end portion 97 and a lower end portion 99 forming respectively the mounting base 103 of first and second roll supports 102. It is thus understood that the roll support assembly 95 is configured to support first and second rolls of web material 50, as represented in FIGS. 20 and 23. Even though in the embodiment shown, the first and second roll supports 102 have a similar structure—so that the following description of one of the first and second roll supports could apply to any of them—it could also be conceived a roll support assembly 95 having more than two roll supports 102 and/or roll supports having different structures.

In the embodiment shown, a recess (or groove) 107 is formed in the engageable portion 105 of the roll support 102; the recess 107 is formed behind the head 114 of the engageable portion 105. In other words, the recess 107 is formed between the second portion 110 and the head 114 of the engageable portion 105 of the roll support 102. The recess 107 extends along at least a portion of an outer periphery of the engageable portion 105. In the embodiment shown, the recess 107 extends along substantially entirely, and preferably, along all of the outer periphery of the engageable portion 105. In other words, an annular groove 107 is formed in the engageable portion 105 of the roll support 102 (for instance in the second portion 110 of the roll support 102). As shown, the recess 107 can define a substantially truncated portion extending between a front end of the second portion 110 and a rear end of the head 114. In other words, the recess 107 is shaped and dimensioned so that the cross section of the engageable portion 105 regularly decreases between the front end of the second portion 110 and the rear end of the head 114. It is however appreciated that the shape and the dimensions of the recess 107 can vary from the embodiment shown.

Figure 21A:
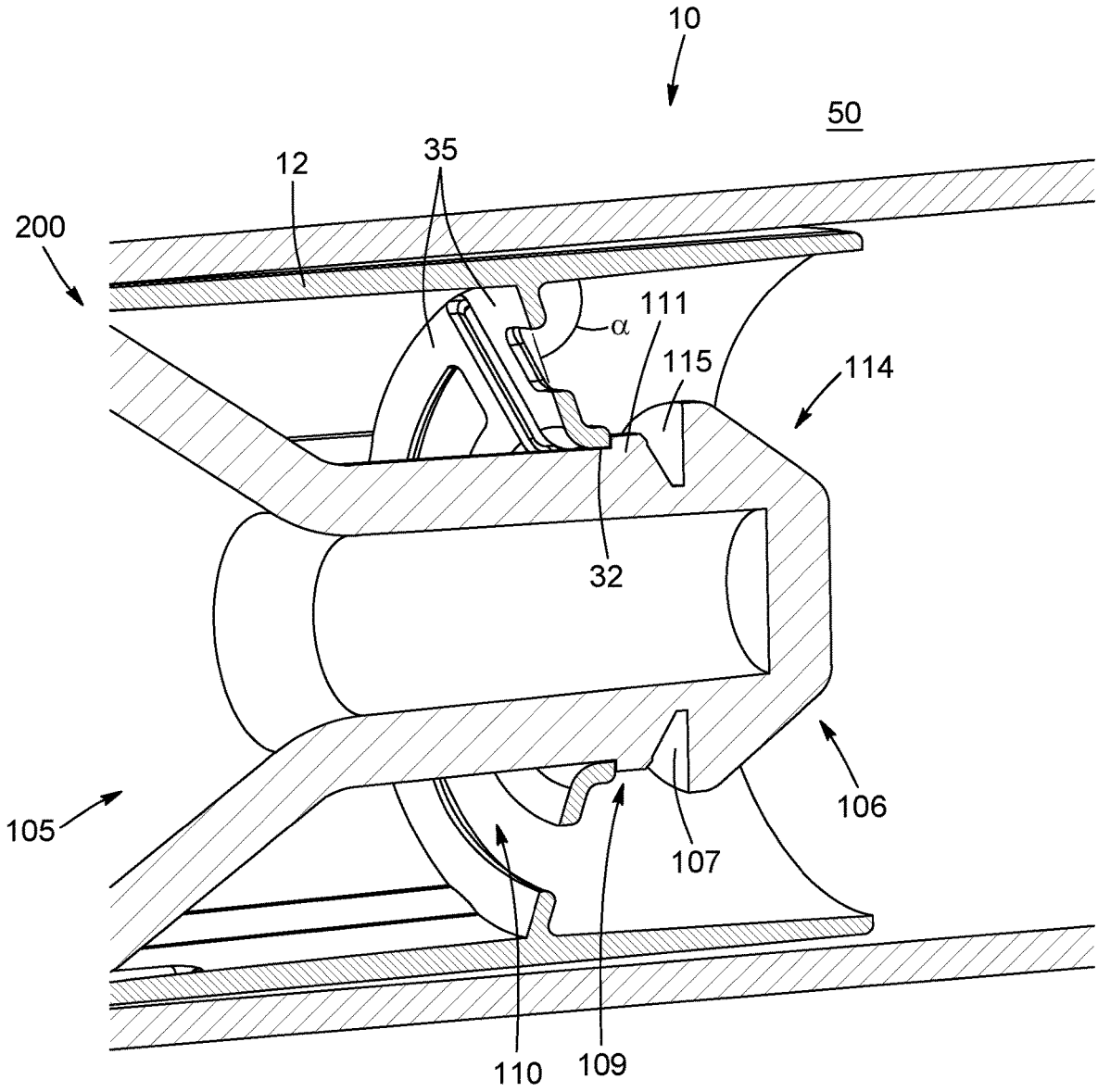
FIGS. 21A, 21B and 21C are enlarged perspective views of the bushing of FIG. 8 supported on the engageable portion of one of the roll supports of FIG. 16, the bushing being respectively in a rolling configuration, a transition configuration and a breaking configuration.
Figure 21B:
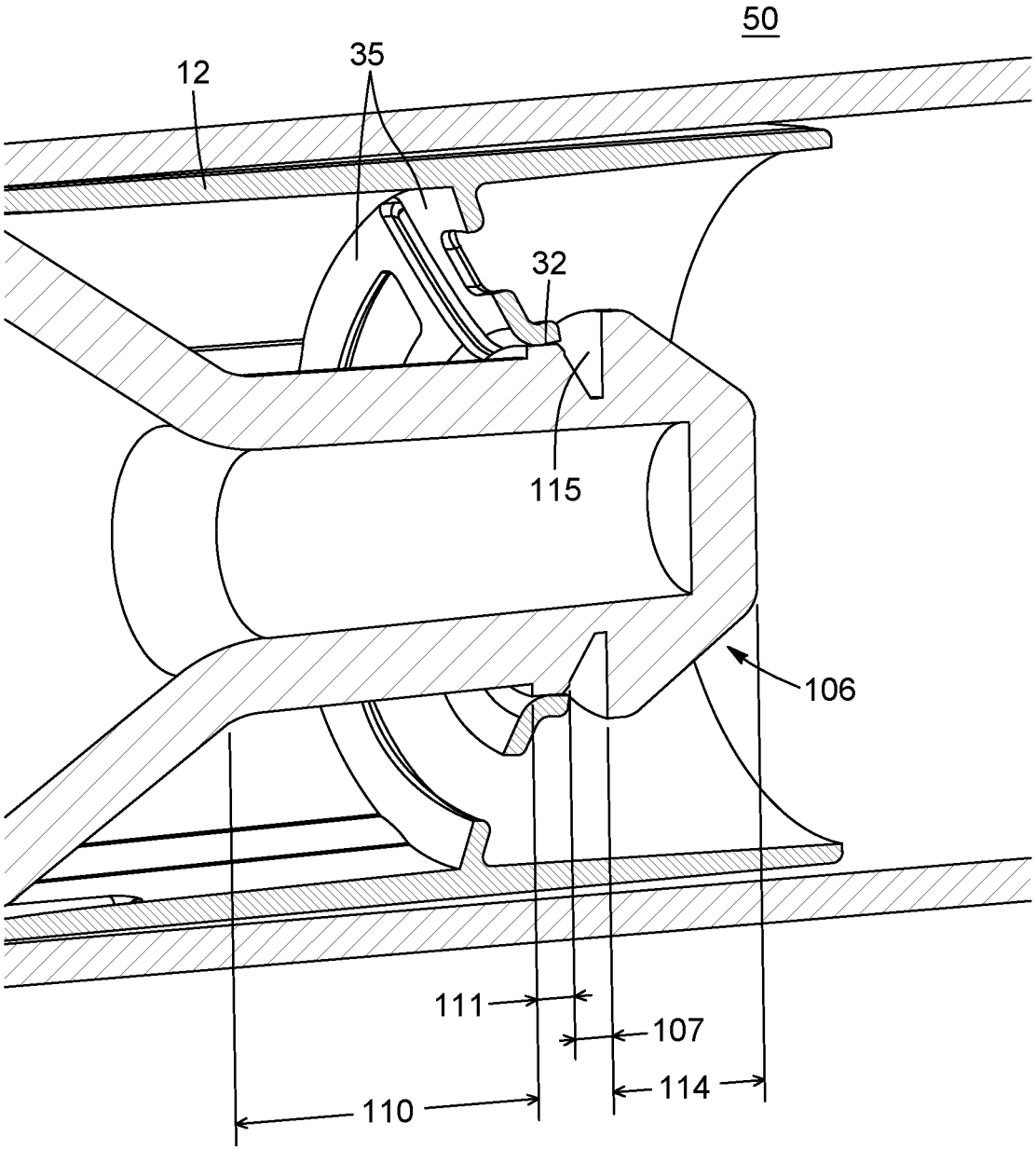
Figure 21C:
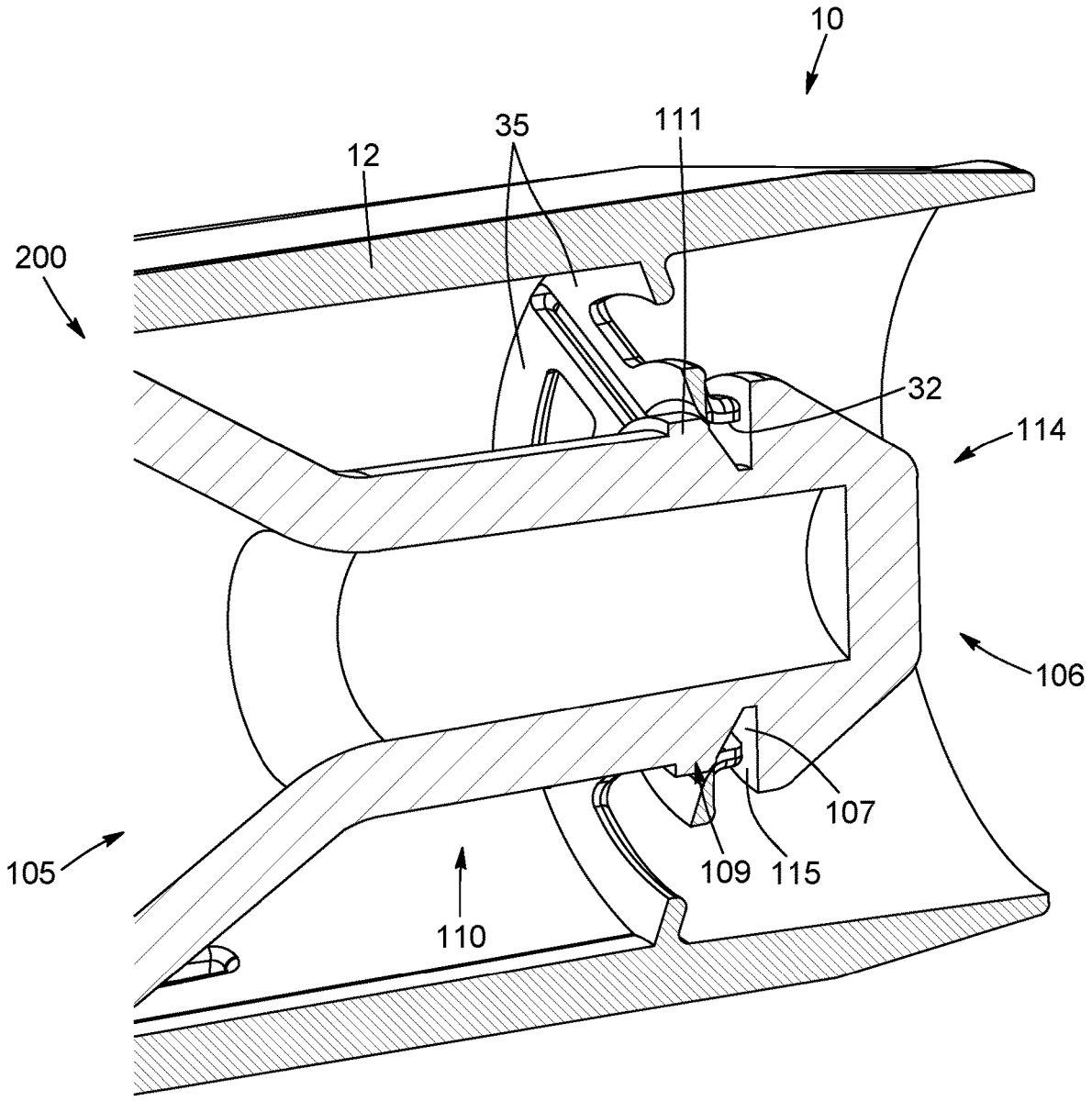

The recess 107 formed in the engageable portion 105 of the roll support 102 is configured so that, when the web material roll 50 and the bushing 10 inserted therein are removed from the roll support 102, as represented in FIG. 21C in which the bushing 10 is in a breaking configuration, the wall partitions 35 are at least partially received in the recess 107. Thus, the abutment surface of the substantially vertically extending face 115 formed between the front end of the second portion 110 and the tapered head 114 against the wall partitions 35 of the wall 28 is increased. Consequently, breaking of the wall 28 is facilitated. In other words, the recess 107 eases breaking of the wall 28 when the roll support 102 is forced out of the bushing 10.

Figure 16:
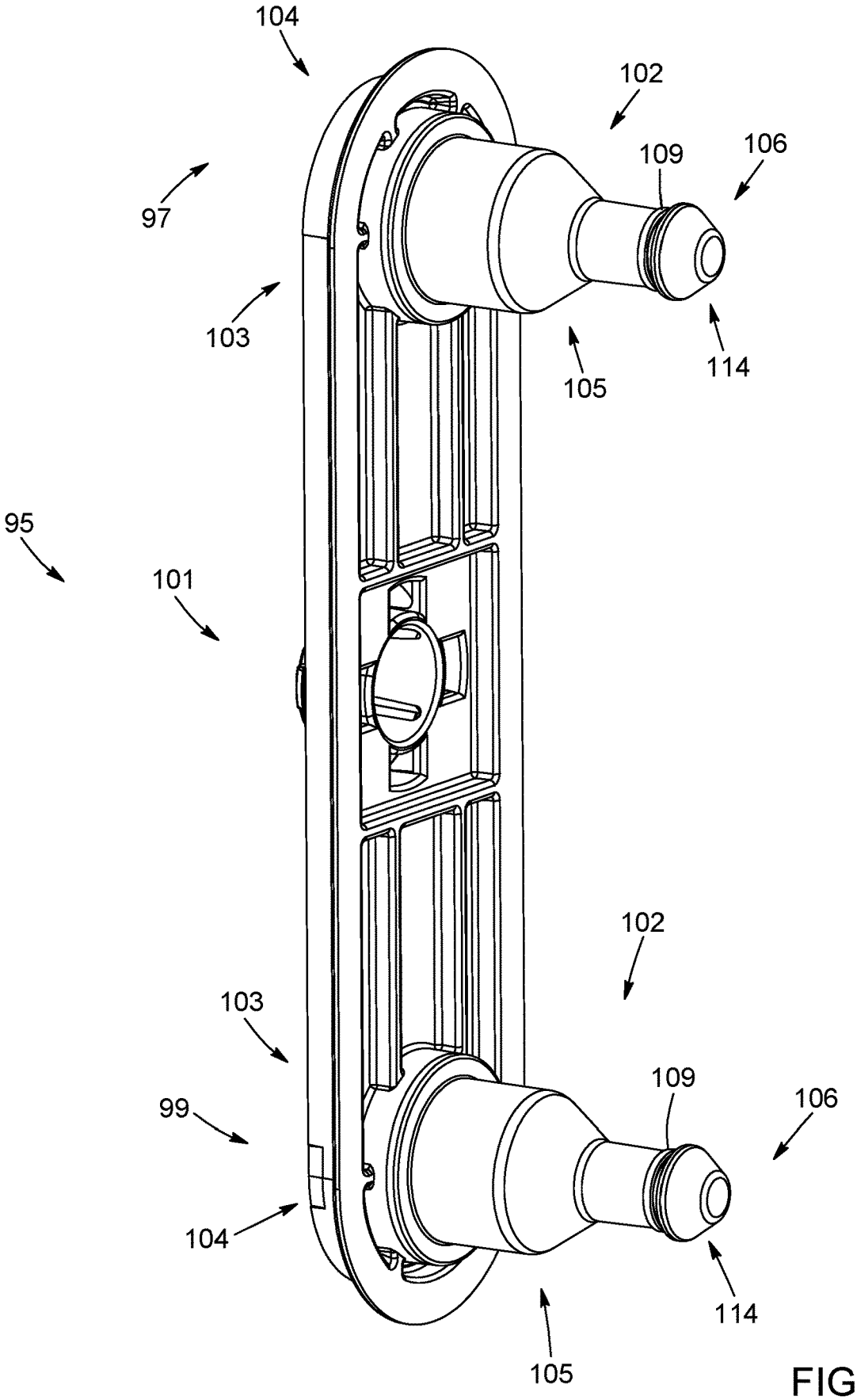
FIG. 16 is a side perspective view of a roll support assembly comprising a roll support mounting plate and first and second roll supports in accordance with another possible embodiment of the invention extending therefrom.
Figure 17:
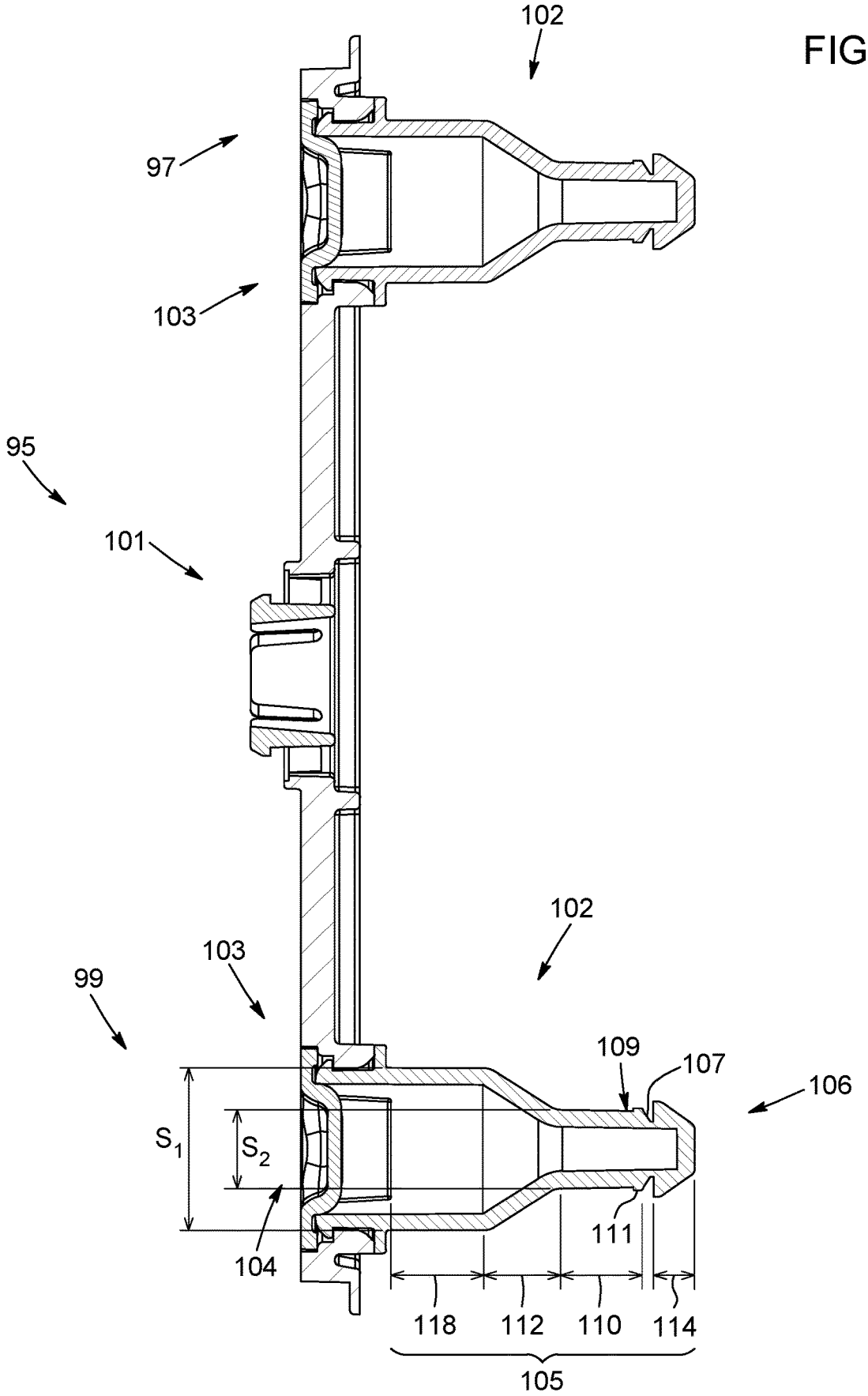
FIG. 17 is a side cross-section view of the roll support assembly of FIG. 16.
Figure 18A:
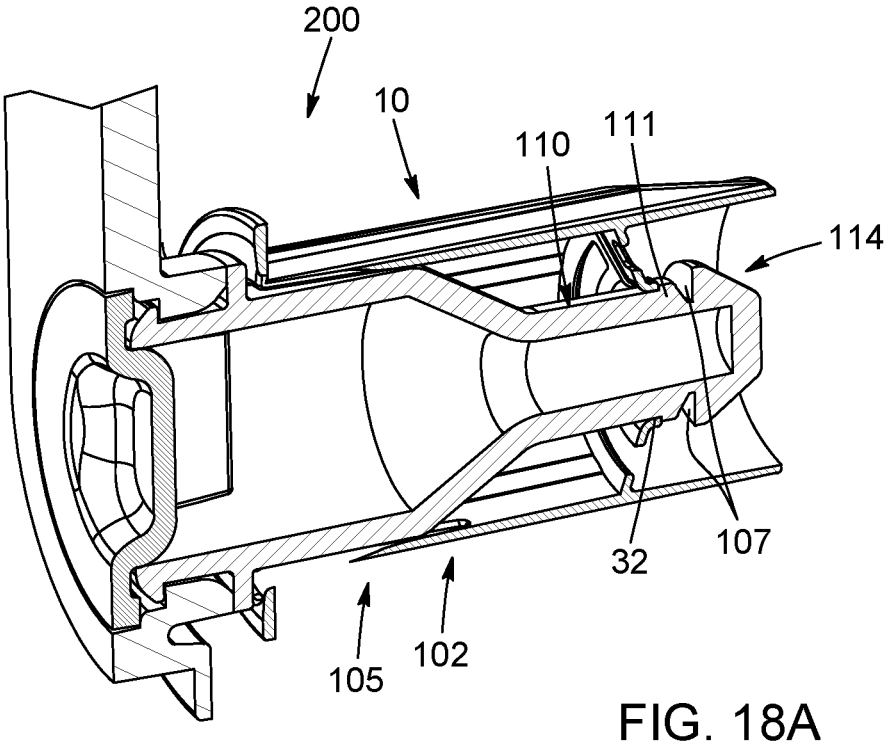
FIGS. 18A and 18B are side perspective cross-section views of the bushing of FIG. 8 supported on an engageable portion of one of the roll supports of FIG. 16.
Figure 18B:
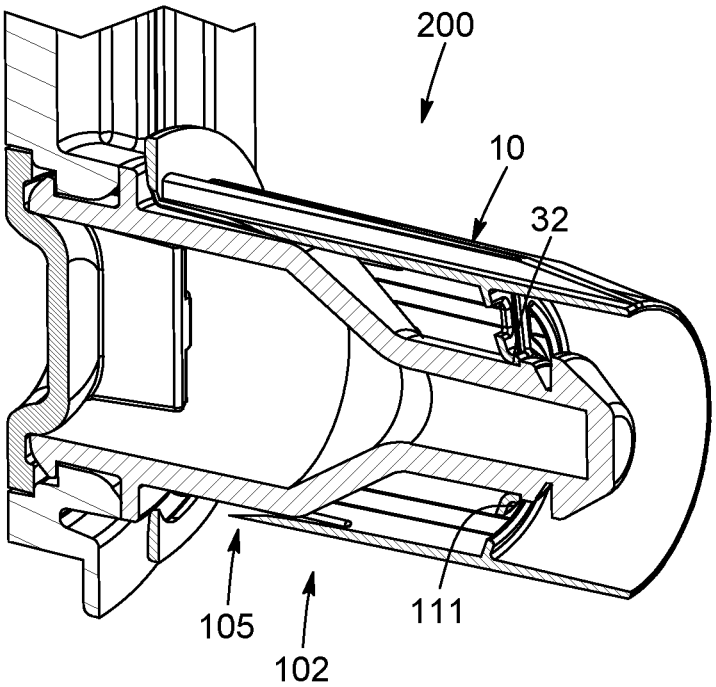
Figure 19:
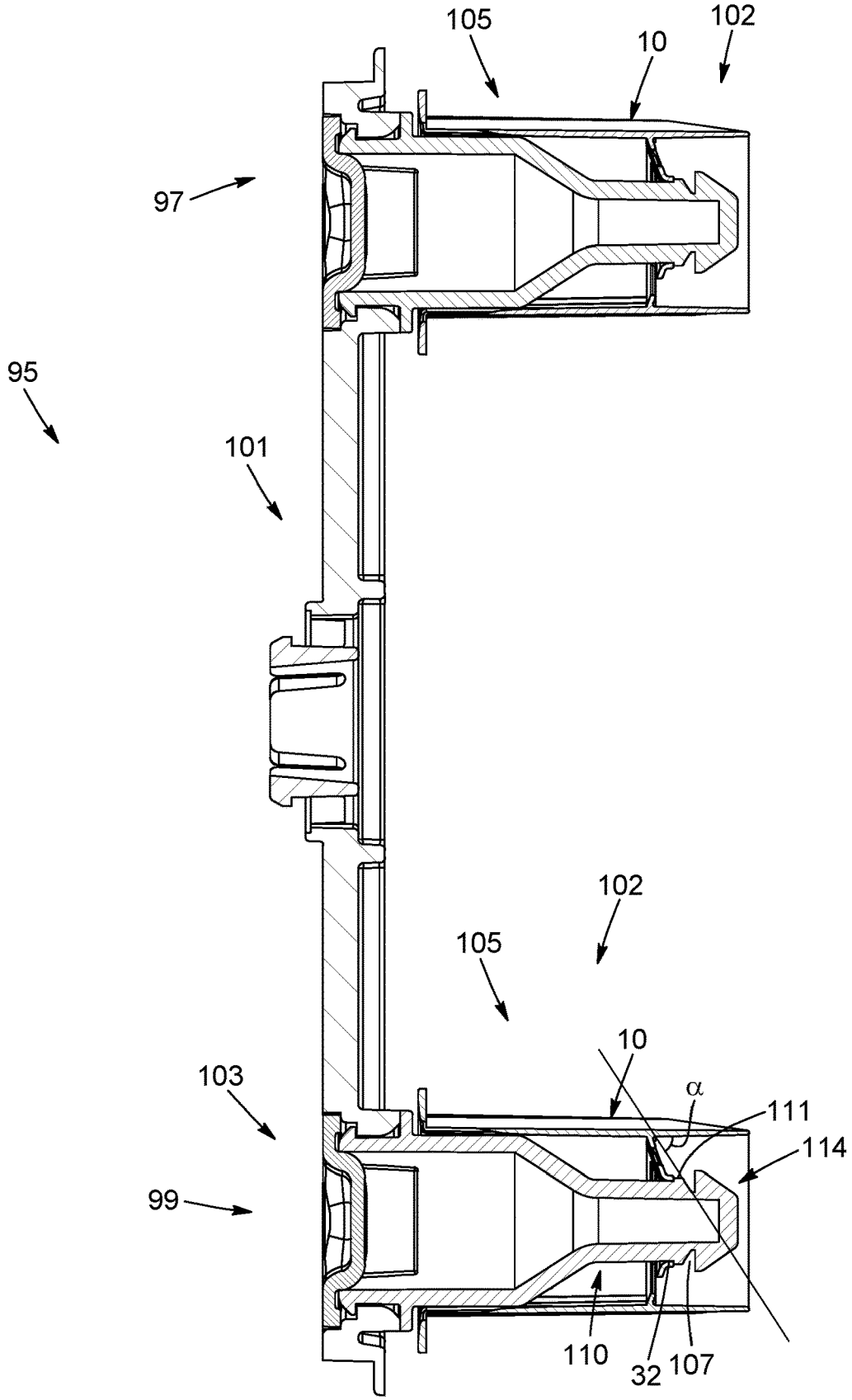
FIG. 19 is a side cross-section view of the bushing of FIG. 8 supported on one of the roll supports of FIG. 16.

Moreover, as represented for instance in FIGS. 16 and 17, the engageable portion 105 might further comprise a blocking ring 109 (or stopper ring 109) mounted to the front end of the second portion 110. The blocking ring 109 forms a blocking protrusion 111 extending from (for instance mounted to) an outer surface of the second portion 110. The blocking protrusion 111 extends along at least a portion of an outer periphery of the second portion 110. In the embodiment shown, the blocking protrusion 111 extends along substantially entirely the outer periphery of the second portion 110. In the embodiment shown, the blocking ring 109 is formed integral with the engageable portion 105, and more particularly with the second portion 110 of the engageable portion 105, but the blocking ring 109 and the second portion 110 of the engageable portion 105 could also be formed of distinct elements fixedly secured together. For instance, an O-ring could be mounted to the outer surface of the second portion 110, proximate the front end of the second portion 110. It is appreciated that the shape and the dimensions of the blocking protrusion 111 can vary from the embodiment shown. For instance, the annular groove 107 is arranged between the blocking ring 109 and the free end 106 of the roll support 102.

It is thus understood that, considered along an axis of the engageable portion 105 of the roll support 102 towards the free end 106, an outer diameter of the engageable portion 105 increases from the second diameter S2 of the second portion 110 to the diameter of the blocking protrusion 111. Then the diameter of the engageable portion 105 of the roll support 102 decreases in the recess 107 and then increases when passing the shoulder 116 defined between the second portion 110 and the tapered head 114.

The blocking protrusion 111 firstly limits the engagement of the roll support 102 in the bushing 10: the blocking protrusion 111 forms a longitudinal blocker to limit the risk that the roll support 102 be introduced too far in the bushing 10, which would result in the first and second bearing surfaces 20, 32 not being adequately arranged with regards to the roll support 102, thus resulting in an inadequate dispensing of the web material of the web material roll 50.

Figure 22:
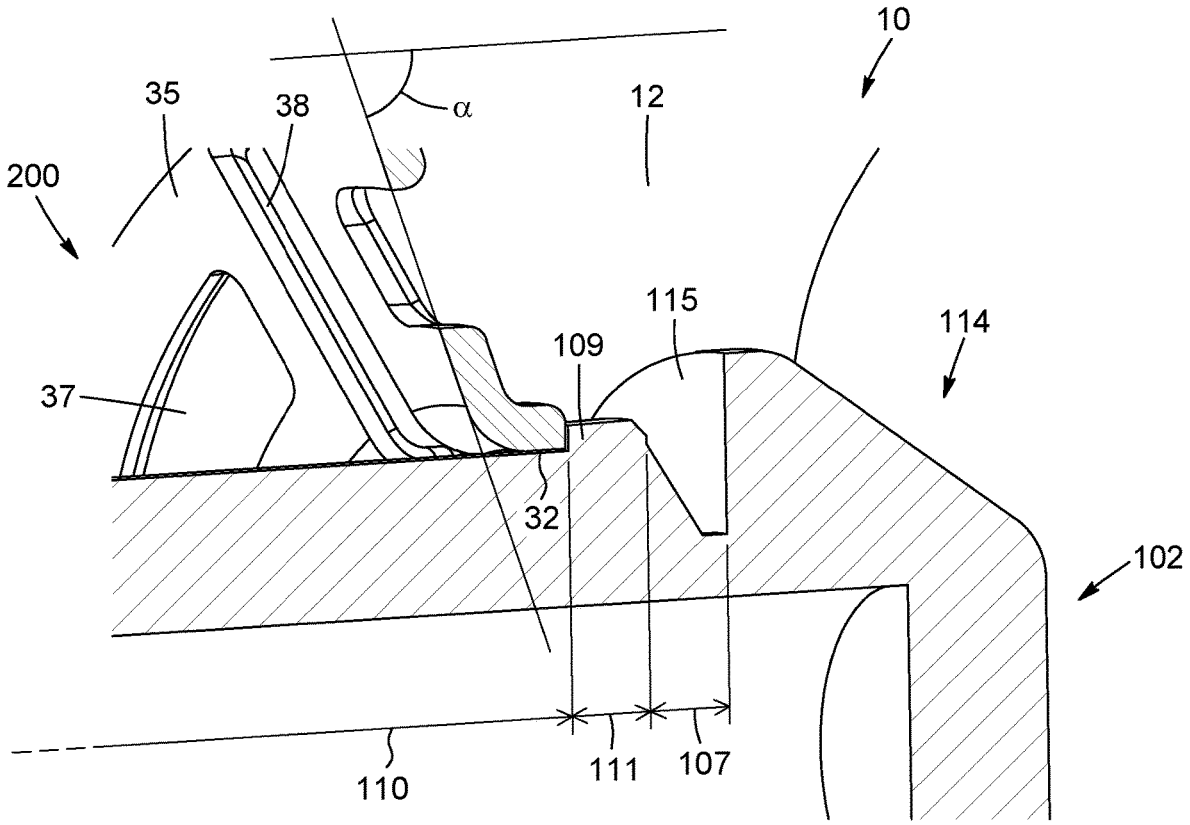
FIG. 22 is another enlarged perspective view of the bushing of FIG. 8 supported on one of the roll supports of FIG. 16, the bushing being in the rolling configuration.
Figure 23:
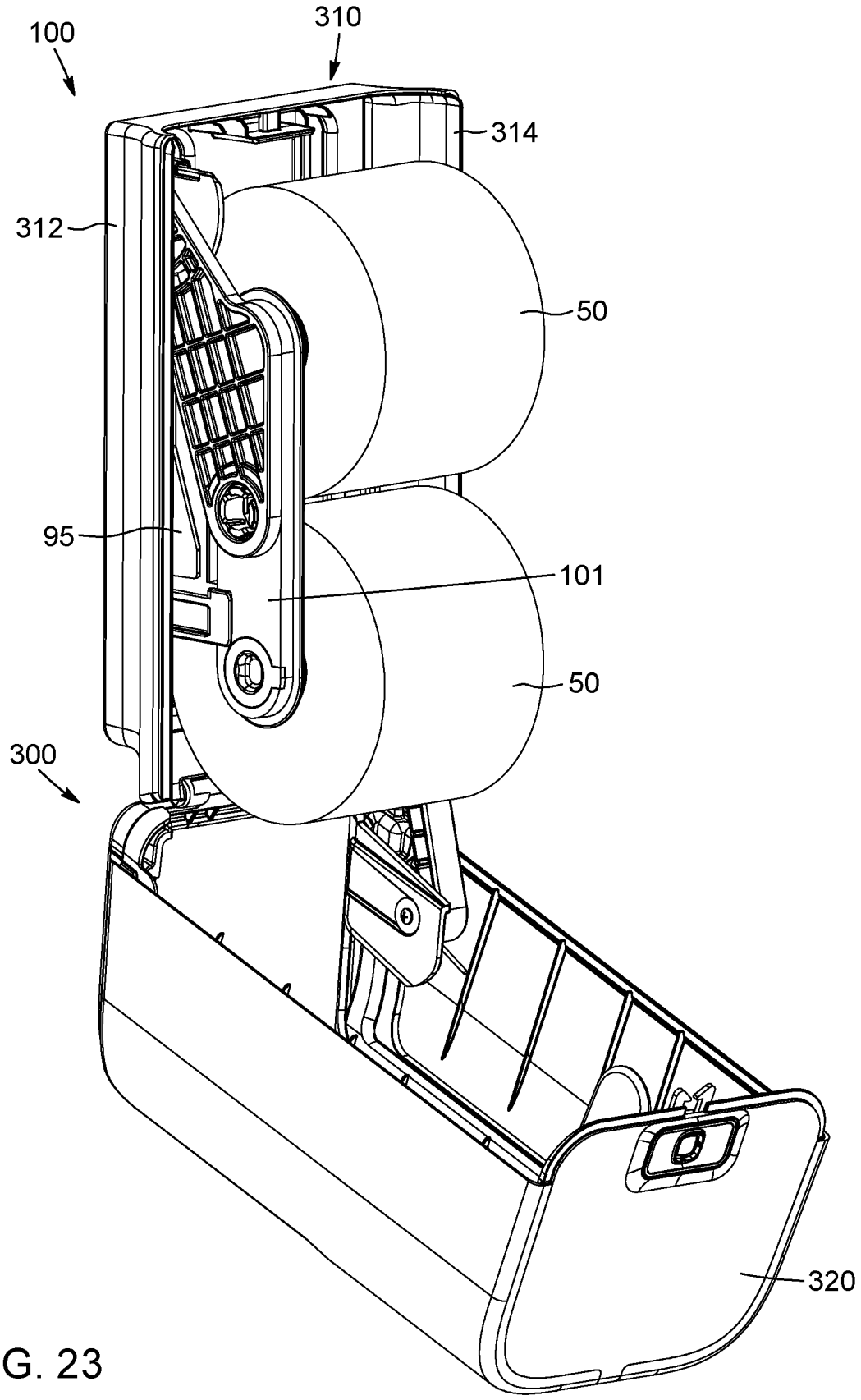
FIG. 23 is a perspective view of a web material dispenser according to an example embodiment in an open state thereof, the dispenser comprising first and second web material roll retention assemblies having bushings in accordance with a possible embodiment of the invention, the first and second web material roll retention assemblies supporting first and second rolls of web material.

As represented for instance in FIGS. 21A, 21B, 21C and 22, the second bearing surface 32 constituted by the roll support contacting surface bordering the opening 30 formed in the wall 28 is configured to contact/slide an outer surface of the front end of the second portion 110 rearwardly from the blocking protrusion 111 of the engageable portion 105 of the roll support 102. In the embodiment shown, as represented in FIGS. 21A and 22, when the roll support 102 is inserted into the bushing 10, the bushing 10 being thus in a rolling configuration, the wall 28 and the second portion 110 of the roll support 102 are configured for the wall partitions 35 to be angled with regards to the inner surface 18 of the body 12 of the bushing 10, when the roll support 102 is inserted into the bushing 10. In an embodiment, when the bushing 10 cooperates with the roll support 102 in the rolling configuration, the wall partitions 35 form an inclination angle $\alpha$ comprised between about 10° and about 80°. In another embodiment, when the bushing 10 cooperates with the roll support 102, the inclination angle $\alpha$ is comprised between about 30° and about 70°. In another embodiment, when the bushing 10 cooperates with the roll support 102, the inclination angle $\alpha$ is comprised between about 40° and about 60°.

Moreover, when the roll support 102 is removed from the bushing 10, the blocking protrusion 111 provides an additional constraint to be overcome by the wall 28 of the bushing 10. In other words, the blocking protrusion 111 contributes to the efficiency of the breaking of the wall partitions 35 of the wall 28 when the bushing 10 is removed from the engageable portion 105 of the roll support 102.

FIG. 21B represents the bushing 10 in a transition configuration, in which the wall partitions 35 of the bushing 10 cooperate with the blocking protrusion 111. The bushing 10 might be configured in the transition configuration either when the roll support 102 is inserted into the bushing 10, before the bushing 10 is configured in the rolling configuration represented in FIG. 21A. The bushing 10 might also be configured in the transition configuration when the roll support 102 is removed from the bushing 10, before the bushing 10 is configured in the breaking configuration represented in FIG. 21C.

It is further understood that the combination of the blocking protrusion 111 and the recess 107 (or annular groove) contributes to the generation of the clicking sound upon insertion of the head 114 of the roll support 102 in the bushing 10.

FIG. 23 represents another embodiment of a web material dispenser 100 including a housing 300 for at least partially housing at least two rolls of web material 50, such as paper rolls. The housing 300 includes a back-wall member 310, having left and right sides and a cover member 320. In the illustrated example, the back-wall member 310 has a left sidewall 312 and a right sidewall 314. The web material dispenser 100 further comprises a roll support assembly 95 in accordance with the embodiment represented in FIGS. 16 to 20, with a roll support mounting plate 101 engaged, for instance, to the left sidewall 312.

The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

What is claimed is:

1. A bushing for a web material roll defining a central cavity having first and second extremities, the web material roll being mountable to a roll support of a web material roll dispenser, the bushing comprising:

a body having first and second ends and an inner surface extending between the first and second ends and at least partially delimiting a cylindrical body cavity, the body being sized to be fitted into the first extremity of the central cavity of the web material roll;

a substantially closed-figure shaped wall extending transversally from the inner surface of the body across the cylindrical body cavity, an opening being formed in the substantially closed-figure shaped wall for receiving at least partially the roll support therethrough when the bushing is in the central cavity of the web material roll, said opening being bordered by a roll support contacting surface, the substantially closed-figure shaped wall being at least partially tiltable about the inner surface of the body upon engagement of the substantially closed-figure shaped wall with the roll support; and one or more bearing surfaces for contacting the roll support and supporting the web material roll, said one or more bearing surfaces comprising at least the roll support contacting surface bordering the opening.

2. The bushing according to claim 1, the roll support having first and second portions, the second portion having a smaller cross-section than a cross-section of the first portion, wherein the one or more bearing surfaces includes distinct first and second bearing surfaces, said first and second bearing surfaces being for rotation against the first and second portions of the roll support.

3. The bushing according to claim 2, wherein the first bearing surface is a first annular region having a first diameter, and the second bearing surface has a second diameter smaller than the first diameter of the first annular region.

4. The bushing according to claim 3, wherein the first bearing surface is located at or near the first end of the body.

5. The bushing according to claim 2, wherein the inner surface of the body located at or near the first end defines the first bearing surface for rotation against the first portion of the roll support.

6. The bushing according to claim 1, wherein the substantially closed-figure shaped wall is annular and spaced away from the first end of the body.

7. The bushing according to claim 1, wherein the substantially closed-figure shaped wall is planar and flexible, for allowing passage of the roll support through the opening when placing the web material roll on the roll support.

8. The bushing according to claim 1, wherein the substantially closed-figure shaped wall is frangible, allowing it to break when the web material roll is removed from the roll support.

9. The bushing according to claim 1, wherein the substantially closed-figure shaped wall comprises juxtaposed wall partitions extending radially in the body, the wall partitions being separated by radial slots.

10. The bushing according to claim 1, wherein the substantially closed-figure shaped wall is located at or near the second end of the body.

11. The bushing according to claim 1, wherein the web material roll comprises a hollow core defining the central cavity with the first extremity of the central cavity of the hollow core of the web material roll having an interior surface, and wherein the body of the bushing has an outer core-superposing surface and comprises at least one braking tab extending longitudinally on said outer core-superposing surface for engaging the interior surface of said first extremity to snugly fit the bushing into the hollow core of the web material roll.

12. The bushing according to claim 1, wherein the bushing further comprises an outside collar extending from and encircling the first end of the body.

13. The bushing according to claim 1, wherein the body and the substantially closed-figure shaped wall are integrally formed as a single component.

14. The bushing according to claim 1, wherein the body has an inner surface, the bushing further comprises braking fingers provided on the inner surface of the body, near the first end, that create friction with the roll support.

15. The bushing according to claim 1, wherein the bushing has a longitudinal bushing axis and wherein the substantially closed-figure shaped wall extends substantially perpendicular to the longitudinal bushing axis.

16. A web material roll comprising:

a roll of web material having a hollow core defining a central cavity, the web material being rolled around the hollow core, the central cavity having first and second extremities, the roll of web material being mountable to a roll support of a web material roll dispenser; and a bushing at least partially inserted in said first extremity of the central cavity and comprising:

a body having first and second ends, an outer core-superposing surface extending between the first and second ends and an opposed inner surface extending between the first and second ends and at least partially delimiting a cylindrical body cavity, the body being fitted into the first extremity of the central cavity of the hollow core;

a wall extending transversally from the inner surface of the body across the cylindrical body cavity, an opening being formed in the wall for receiving at least partially the roll support therethrough, said opening being bordered by a roll support contacting surface, the wall being at least partially tiltable about the inner surface of the body upon engagement of the wall with the roll support; and one or more bearing surfaces for contacting the roll support and supporting the roll of web material, said one or more bearing surfaces comprising at least the roll support contacting surface bordering the opening.

17. The web material roll according to claim 16, wherein the roll of web material has first and second opposed lateral sides extending respectively at the first and second extremities of the central cavity, the bushing having an outside collar abutting the first lateral side.

18. A web material roll retention assembly for a web material roll dispenser, the assembly comprising:

a roll support for supporting at least partially a web material roll defining a central cavity and having first and second extremities, the roll support including:

a first portion proximate to a housing of the web material dispenser;

a free end, opposite the housing of the web material dispenser;

a second portion extending between the free end and the first portion, the second portion having a smaller cross-section than a cross-section of the first portion; and a bushing comprising:

a body having first and second ends and an inner surface extending between the first and second ends and at least partially delimiting a cylindrical body cavity, the body being sized to be fitted into one of the first and second extremities of the central cavity of the web material roll;

a substantially closed-figure shaped wall extending transversally from the inner surface of the body across the cylindrical body cavity, an opening being formed in the substantially closed-figured shaped wall for receiving at least partially the roll support therethrough when the bushing is in the central cavity of the web material roll, said opening being bordered by a roll support contacting surface, the substantially closed-figure shaped wall being at least partially tiltable about the inner surface of the body upon engagement of the substantially closed-figure shaped wall with the roll support; and one or more bearing surfaces for contacting the roll support and supporting the web material roll, said one or more bearing surfaces comprising at least the roll support contacting surface bordering the opening.

19. The web material roll retention assembly according to claim 18, wherein the roll support comprises a mounting base, mountable to the housing of the dispenser, the roll support being fixed relative to the housing when mounted thereto.

20. The web material roll retention assembly according to claim 19, wherein the distance between the mounting base and the free end is similar to or greater than the distance between the first and second ends of the body.

21. The web material roll retention assembly according to claim 18, wherein insertion of the roll support within the opening of the bushing generates an audible indication of proper installation of the web material roll on the roll support.

22. The web material roll retention assembly according to claim 21, wherein said audible indication is a clicking sound resulting from forcing the free end of the roll support into the opening of the bushing, momentarily deforming the substantially closed-figure shaped wall of the bushing.

23. The web material roll retention assembly according to claim 22, wherein the free end has at least one region with a cross-section greater than the cross-section of the opening of the bushing.

24. The web material roll retention assembly according to claim 18, the roll support further comprising a head bulging at the free end.

25. The web material roll retention assembly according to claim 18, wherein the size of the first and second portions of the roll support, and the distance of the substantially closed-figure shaped wall of the bushing relative to the second end of the body are set according to different types of web material rolls.

26. A method for placing a web material roll in a web material roll dispenser, the web material roll dispenser having a roll support with a free end and first and second portions, the web material roll having a hollow core defining a central cavity having first and second extremities, the web material being rolled around the hollow core, the method comprising the steps of:

providing a bushing comprising:

a body having first and second ends, an outer core-superposing surface extending between the first and second ends and an opposed inner surface extending between the first and second ends and at least partially delimiting a cylindrical body cavity;

a wall extending transversally from the inner surface of the body across the cylindrical body cavity with an opening formed therein, said opening being bordered by a roll support contacting surface; and one or more bearing surfaces comprising at least the roll support contacting surface bordering the opening;

inserting the bushing in the central cavity of the web material roll, the first end of the body of the bushing being proximate one of said first and second extremities of the web material roll;

inserting the roll support in the body of the bushing; and inserting the free end of the roll support within the opening of the wall, thereby at least partially tilting the wall about the inner surface of the body and engaging the one or more bearing surfaces of the bushing with at least one of the first and second portions of the roll support.

27. The method according to claim 26, comprising confirming proper insertion of the web material roll onto the roll support, when detecting a clicking sound generated by the passage of the roll support into the opening of the bushing.

* * * * *